US008206880B2

(12) United States Patent
Tada et al.

(10) Patent No.: US 8,206,880 B2
(45) Date of Patent: Jun. 26, 2012

(54) ELECTROPHOTOGRAPHIC PHOTORECEPTOR, AND IMAGE FORMING APPARATUS AND PROCESS CARTRIDGE THEREFOR USING THE PHOTORECEPTOR

(75) Inventors: Hiromi Tada, Numazu (JP); Masafumi Ohta, Susono (JP); Tatsuya Niimi, Numazu (JP); Norio Nagayama, Numazu (JP); Yoshiki Yanagawa, Numazu (JP); Yuuji Tanaka, Namazu (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 12/792,303

(22) Filed: Jun. 2, 2010

(65) Prior Publication Data

US 2010/0310975 A1 Dec. 9, 2010

(30) Foreign Application Priority Data

Jun. 5, 2009 (JP) ..... 2009-136158
Jun. 5, 2009 (JP) ..... 2009-136166

(51) Int. Cl.
*G03G 5/00* (2006.01)

(52) U.S. Cl. ..... 430/56; 430/59.2; 430/59.4; 399/159

(58) Field of Classification Search ..... 430/56, 430/59.2, 59.4; 399/159
See application file for complete search history.

(56) References Cited

U.S. PATENT DOCUMENTS 4,314,015 A * 2/1982 Hashimoto et al. ..... 430/59.3
5,190,839 A 3/1993 Fujimaki et al.
5,576,131 A 11/1996 Takai et al.
6,136,483 A 10/2000 Suzuki et al.
6,218,063 B1 4/2001 Tanaka et al.
6,265,123 B1 7/2001 Kakui et al.
6,440,631 B1 8/2002 Kawamorita et al.
2005/0202329 A1 9/2005 Suzuki
2009/0005546 A1 1/2009 Ohta

FOREIGN PATENT DOCUMENTS

EP 0658814 A2 6/1995
EP 0743561 A2 11/1996
EP 0982631 A2 3/2000
EP 0982633 A1 3/2000
EP 1018672 A1 7/2000
EP 2008995 A2 12/2008
JP 47-37543 12/1972
JP 52-8832 1/1977
JP 52-55643 5/1977
JP 56-11945 2/1981

(Continued)

OTHER PUBLICATIONS

Sep. 1, 2010 European search report in connection with counterpart European patent application No. 10164984.

*Primary Examiner* — Mark A Chapman
(74) *Attorney, Agent, or Firm* — Cooper & Dunham LLP

(57) ABSTRACT

An electrophotographic photoreceptor, including an electroconductive substrate; and a photosensitive layer overlying the substrate, wherein the photosensitive layer comprises a complex azo pigment comprising an azo compound having the following formula (a):

$$A(H)n \quad (a)$$

wherein A represents a residue of an azo compound, bonded with n pieces of hydrogen atom through one or more heteroatom being N or O and forming a part of the residue A; H represents a hydrogen atom; and n represents an integer of from 1 to 9,
and a pigment.

13 Claims, 3 Drawing Sheets

FOREIGN PATENT DOCUMENTS

| | | |
|---|---|---|
| JP | 58-182639 | 10/1983 |
| JP | 58-222152 | 12/1983 |
| JP | 58-222153 | 12/1983 |
| JP | 59-44053 | 3/1984 |
| JP | 60-59355 | 4/1985 |
| JP | 61-29496 | 2/1986 |
| JP | 61-109056 | 5/1986 |
| JP | 61-239248 | 10/1986 |
| JP | 61-273994 | 12/1986 |
| JP | 62-62367 | 3/1987 |
| JP | 62-67094 | 3/1987 |
| JP | 63-364 | 1/1988 |
| JP | 63-366 | 1/1988 |
| JP | 63-198067 | 8/1988 |
| JP | 64-17066 | 1/1989 |
| JP | 1-123868 | 5/1989 |
| JP | 1-221459 | 9/1989 |
| JP | 3-9962 | 1/1991 |
| JP | 5-263007 | 10/1993 |
| JP | 5-279591 | 10/1993 |
| JP | 9-127711 | 5/1997 |
| JP | 2001-290296 | 10/2001 |
| JP | 2002-23399 | 1/2002 |
| JP | 3330389 | 7/2002 |
| JP | 2005-15682 | 1/2005 |
| JP | 2007-334099 | 12/2007 |
| JP | 2009-7523 | 1/2009 |

* cited by examiner

ELECTROPHOTOGRAPHIC PHOTORECEPTOR, AND IMAGE FORMING APPARATUS AND PROCESS CARTRIDGE THEREFOR USING THE PHOTORECEPTOR

BACKGROUND OF THE INVENTION

1. Field of the Invention

The present invention relates to a highly stable photoreceptor having high sensitivity and stably producing quality images even when repeatedly used, and to an image forming apparatus and a process cartridge therefore using the photoreceptor.

2. Discussion of the Related Art

Recently, developments in information processing systems using electrophotography have proceeded rapidly. In particular, laser printers and digital copiers converting information into digital signals with light have been dramatically improved in terms of print quality and reliability. The laser printers and digital copiers now so widespread are required to reliably produce high-quality images at high speed.

Electrophotographic photoreceptors using organic photosensitive materials are widely used in image forming apparatuses because of the advantages they offer in terms of cost, productivity, environmental stability, etc.

In particular, azo pigments and phthalocyanine pigments are effectively used as charge generation materials for use in organic photoreceptors. As the azo pigments, Japanese published unexamined applications Nos. 47-37543 and 52-55643 disclose benzidine bisazo compounds; Japanese published unexamined application No. 52-8832 discloses stilbene bisazo compounds; Japanese published unexamined application No. 58-222152 discloses diphenylhexatriene bisazo compounds; and Japanese published unexamined application No. 58-222153 discloses diphenylbutadiene bisazo compounds.

Phthalocyanine includes a titanyl phthalocyanine pigment, a metal-free phthalocyanine pigment, a hydroxy gallium phthalocyanine pigment, etc. Specific examples of the titanyl phthalocyanine pigment include an $\alpha$-type disclosed in Japanese published unexamined publication No. 61-239248, a Y-type disclosed in Japanese published unexamined publication No. H01-17066, an I-type disclosed in Japanese published unexamined publication No. 61-109056, an A-type disclosed in Japanese published unexamined publication No. 62-67094, a B-type disclosed in Japanese published unexamined publications Nos. 63-364 and 63-366, a B-type disclosed in Japanese published unexamined publication No. 2005-15682, a m-type disclosed in Japanese published unexamined publication No. 63-198067, and a semi-amorphous type disclosed in Japanese published unexamined publication No. H01-123868, etc. Specific example of the metal-free phthalocyanine pigment include a X-type metal-free phthalocyanine disclosed in U.S. Pat. No. 3,357,989, a $\tau$-type metal-free phthalocyanine disclosed in Japanese published unexamined publication No. 58-182639, etc. Specific examples of the hydroxy gallium pigment are disclosed in Japanese published unexamined publications Nos. 5-263007 and 5-279591. Specific examples of copper phthalocyanine pigments are disclosed in Japanese published unexamined publications Nos. 58-100134, 61-273994, 62-62367, etc. Specific examples of chlorophthalocyanine pigments are disclosed in Japanese published unexamined publications Nos. 59-44053, 1-221459, etc. Specific examples of chloroindiumphthalocyanine pigments are disclosed in Japanese published unexamined publication No. 60-59355, etc.

However, a photoreceptor using a single pigment of these suffices neither for sensitivity nor stability in usage environment and over time, and does not suffice for future high-quality or high-speed copier photoreceptor. In order to solve this problem, use of combinations of two or more pigments is known. For example, Japanese published unexamined publications Nos. 5-301292 and 2001-290296 disclose a combination of a metal-free phthalocyanine pigment and fluorenone azo pigment. Japanese published unexamined publication No. 9-127711 discloses a combination of a phthalocyanine compound and an azo pigment. Japanese published unexamined publication No. 2002-23399 discloses a combination of a metal phthalocyanine and a perylene pigment. Japanese published unexamined publication No. 2007-334099 discloses a combination of a quinacridone pigment and a titanylphthalocyanine pigment. Japanese published unexamined publication No. 3-9962 discloses a combination of a titanylphthalocyanine pigment and another phthalocyanine pigment. However, even these do not suffice, because the above-mentioned pigments typically have very low solubility in organic solvents and are difficult to uniformly disperse therein, and moreover can be purified only with organic solvents and thus impurities are thought not to be fully removed.

The present inventor discloses an azo pigment having improved solubility in an organic solvent in Japanese published unexamined publication No. 2009-7523, so that a photoreceptor can be prepared with a uniformly-dispersed coating liquid.

With a single charge generation material it is difficult to prepare a photoreceptor having sufficient properties, and therefore a combination of two or more charge generation materials can be contemplated.

Since mechanical means such as milling are mostly used to mix plural pigments they cannot be mixed or combined on the molecular level, and thus the organic photoconductors are thought not to have attained their full functions. In addition, methods of using an acid paste together are disclosed, but a concentrated sulfuric acid used therein is a problem in mixing and possibly decomposes as a pigment, resulting in usage limitation. Further, crystal transformation is made or a desired crystal form is not obtained when mixed with an acid paste, resulting in a photoreceptor having insufficient properties.

Accordingly, a good charge generation material is desired to achieve an electrophotographic photoreceptor having none of the conventional defects.

Because of these reasons, a need exists for a high-sensitive electrophotographic photoreceptor preventing charge accumulation therein due to a charge generation material to produce high-quality images without image defects at high speed for long periods.

SUMMARY OF THE INVENTION

Accordingly, an object of the present invention is to provide a high-sensitive electrophotographic photoreceptor preventing charge accumulation therein due to a charge generation material to produce high-quality images without image defects at high speed for long periods.

Another object of the present invention is to provide an image forming apparatus using the electrophotographic photoreceptor.

A further object of the present invention is to provide a process cartridge for image forming apparatus, using the electrophotographic photoreceptor.

To achieve such objects, the present invention contemplates the provision of an electrophotographic photoreceptor, comprising:

an electroconductive substrate; and a photosensitive layer, overlying the substrate, wherein the photosensitive layer comprises a complex azo pigment comprising:

a first azo compound having the following formula (a);

$$A(H)n \quad (a)$$

wherein A represents a residue of an azo compound, bonded with n pieces of hydrogen atom through one or more heteroatom being N or O and forming apart of the residue A; H represents a hydrogen atom; and n represents an integer of from 1 to 9, and a pigment, wherein the first azo compound is prepared by dissolving and de-carbo esterifying a second azo compound having a carbo-ester group and the following formula (I):

$$A(E)n \quad (I)$$

wherein A represents a residue of an azo compound, bonded with, n pieces of E group through one or more heteroatom being N or O and forming a part of the residue A; E independently represents a hydrogen atom or a carbo-ester group having a formula of —C(═O)—O—R1 wherein R1 represents a substituted or an unsubstituted alkyl group having 4 to 10 carbon atoms, an alkenyl group, an alkynyl group, a cycloalkyl group, a cycloalkenyl group or an aralkyl group; and n represents an integer of from 1 to 9.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
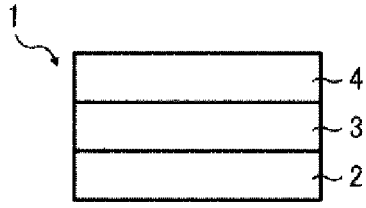
FIG. 1 is a schematic view illustrating a layer structure of the electrophotographic photoreceptor of the present invention.

Generally, the present invention provides an electrophotographic photoreceptor including a complex azo pigment in its photosensitive layer and an electrophotographic image forming apparatus using the electrophotographic photoreceptor to produce high-quality images without image defects at high speed for long periods. More particularly, the present invention relates to an electrophotographic photoreceptor, comprising:

an electroconductive substrate; and a photosensitive layer, overlying the substrate, wherein the photosensitive layer comprises a complex azo pigment comprising:

a first azo compound having the following formula (a);

$$A(H)n \quad (a)$$

wherein A represents a residue of an azo compound, bonded with n pieces of hydrogen atom through one or more heteroatom being N or O and forming a part of the residue A; H represents a hydrogen atom; and n represents an integer of from 1 to 9, and a pigment, wherein the first azo compound is prepared by dissolving and de-carbo esterifying a second azo compound having a carbo-ester group and the following formula (I):

$$A(E)n \quad (I)$$

wherein A represents a residue of an azo compound, bonded with n pieces of E group through one or more heteroatom being N or O and forming a part of the residue A; E independently represents a hydrogen atom or a carbo-ester group having a formula of —C(═O)—O—R1 wherein R1 represents a substituted or an unsubstituted alkyl group having 4 to 10 carbon atoms, an alkenyl group, an alkynyl group, a cycloalkyl group, a cycloalkenyl group or an aralkyl group; and n represents an integer of from 1 to 9.

The complex azo pigment of the present invention is prepared by dissolving an azo compound having a carbo-eater group, high solubility in organic solvents and the formula (1) in an organic solvent together with another pigment to prepare a solution in which the azo compound contacts the pigment in a molecular state or two or more azo compound having the formula (1) in an organic solvent to prepare a solution; and chemically, thermally or photolytically de-carbo esterifying the solution.

Therefore, the complex azo pigment of the present invention is highly dispersed on the molecular level and has a bond so that the resultant photoreceptor has high sensitivity and stably produces quality images even when formed of two or more pigments originally have low solubility in organic solvents and are hard to highly disperse, and it is basically different from a mixture of plural pigments subjected to conventional milling.

Similar to dissolving two or more pigments, two or more pigments are mixed when subjected to acid paste. A pigment having a large difference of charge generatability depending on a crystal form has crystal transformation when subjected to acid paste, and does not have a desired crystal form and the resultant photoreceptor does not have sufficient sensitivity in many cases. In the present invention, an azo pigment can be bonded with a pigment having a desired crystal form on the molecular level, and the resultant photoreceptor has higher sensitivity.

The complex azo pigment of the present invention can also be prepared by coating a pigment with a de-carbo esterified azo pigment having the formula (a). Depending on the pigment, a highly stable charge generation material having properties difficult to vary due to external factors can be obtained, and the resultant photoreceptor is highly stable.

One of large problems of a charge generation layer coating liquid is dispersion stability of a pigment. Therefore, pigments usable as charge generation materials and formulations of the charge generation layer coating liquid are limited and some properties of photoreceptors are occasionally sacrificed. However, an azo pigment having high dispersion stability and coating another pigment can solve a problem of dispersion stability. Therefore, a charge generation material having been unable to be used because of dispersion stability can be used, and the formulations of the charge generation layer coating liquid can be designed so that the resultant photoreceptor has properties having been unrealizable.

A phthalocyanine pigment is preferably combined with an azo pigment. The phthalocyanine pigment is typically known to have high sensitivity in a specific crystal form even when used alone, and noticeably improves and stabilizes electrostatic properties of the resultant photoreceptor when combined with an azo pigment as in the present invention.

Various reasons can be thought for these effects. The azo pigment covering the phthalocyanine pigment transformable to a low-sensitive crystal will be a very stable charge generation material difficult to change due to external factors, and the resultant photoreceptor produces stable-quality images under any environment.

Namely, one of large problems of a charge generation layer coating liquid is dispersion stability of a pigment. Therefore, pigments usable as charge generation materials and formulations of the charge generation layer coating liquid are limited and some properties of photoreceptors are occasionally sacrificed. Particularly, the phthalocyanine pigment typified by a γ-type titanylphthalocyanine pigment imparts high sensitivity, but does not impart sufficient properties to the resultant photoreceptor in many cases.

Specifically, a binder resin in a charge generation layer coating liquid is enriched to maintain sufficient crystal stability and shearing strength when preparing the coating liquid is prevented so that the binder resin does not have sufficiently small particle diameter in consideration of crystal transformation. These adversely affect photoreceptor properties such as sensitivity.

However, in the present invention, a phthalocyanine pigment having a desired crystal form, which is covered by an azo pigment has higher crystal stability. Therefore, the above-mentioned methods are not necessary to maintain a crystal form and a coating liquid in which a resin is highly-dispersed to have a small particle diameter can be formed to produce better electrophotographic images.

When a phthalocyanine pigment typically having high electron transportability is used alone in a charge generation layer, a charge is easy to trap and a potential is easy to vary when repeatedly used. In order to solve this, an n-type pigment is mixed by milling or an electron transport material is dispersed in a charge generation layer. An n-type azo pigment having an electron absorbing structure can be bonded with the complex phthalocyanine pigment of the present invention on the molecular level, and the resultant photoreceptor has high sensitivity and potential stability impossible by conventional technologies.

In addition, a method of mixing another pigment with the phthalocyanine pigment in acid pasting is known, but it is difficult to control a crystal form of the phthalocyanine pigment. Therefore, the phthalocyanine pigment does not have a desired crystal form and the resultant photoreceptor does not have sufficient photoreceptor properties in many cases. The complex phthalocyanine pigment of the present invention bonded with an azo pigment on the molecular level solves such a problem.

When a complex azo pigment is obtained by dissolving at least two azo compounds having the formula (1) in an organic solvent to prepare a solution; and chemically, thermally or photolytically de-carbo esterifying the solution, plural azo compounds coexist in the process of becoming a pigment and a crystal size growth can be prevented. A pigment having a primary particle diameter smaller than a single azo pigment can be synthesized and the resultant photoreceptor has high sensitivity.

Thus, the complex azo pigment solves these problems and provides a high-sensitive electrophotographic photoreceptor having very stable potential regardless of used hours and usage environment, and an image forming apparatus producing images having stable quality.

Next, the photoreceptor of the present invention will be explained, referring to the drawings.

As shown in FIG. 1, a photoreceptor 1 is formed of a charge generation layer (CGL) 3 including a charge generation material (CGM) as a main component and a charge transport layer (CTL) 4 including a charge transport material (CTM) as a main component on an electroconductive substrate 2.

Figure 2:
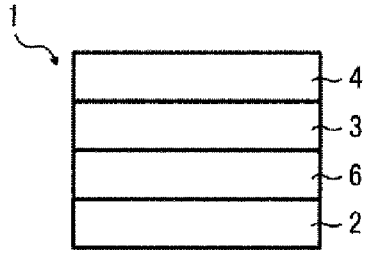
FIG. 2 is a schematic view illustrating another layer structure of the electrophotographic photoreceptor of the present invention.

As shown in FIG. 2, a photoreceptor 1 may include an undercoat layer 6 or an intermediate layer between an electroconductive substrate 2 and a CGL 3.

Figure 3:
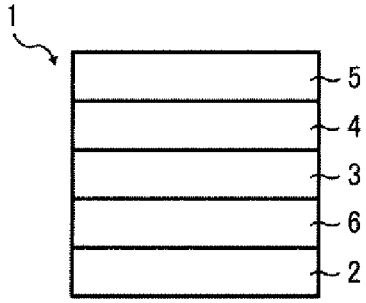
FIG. 3 is a schematic view illustrating a further layer structure of the electrophotographic photoreceptor of the present invention.

As shown in FIG. 3, a photoreceptor 1 may include a protection layer 5 on a CTL 4.

Figure 4:
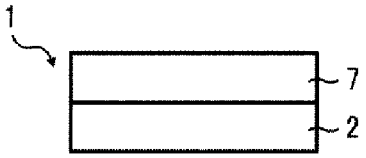
FIG. 4 is a schematic view illustrating another layer structure of the electrophotographic photoreceptor of the present invention.

As shown in FIG. 4, a photoreceptor 1 may be a single-layered photoreceptor including a photosensitive layer 7 on an electroconductive substrate 2.

<Electroconductive Substrate>

Suitable materials for the electroconductive substrate 31 include materials having a volume resistance not greater than $10^{10}$ Ω·cm. Specific examples of such materials include plastic cylinders, plastic films or paper sheets whose surface is deposited or sputtered with a metal such as aluminum, nickel, chromium, nichrome, copper, gold, silver, platinum, etc., or a metal oxide such as tin oxides, indium oxides, etc. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of metals such as nickel and stainless steel can also be used as the substrate.

Besides, substrates on which a coating liquid including a binder resin and an electroconductive powder is coated can also be used as the substrate. Specific examples of such an electroconductive powder include carbon black, acetylene black, powders of metals such as aluminum, nickel, iron, Nichrome, copper, zinc, silver, etc., and metal oxides such as electroconductive tin oxides, ITO.

Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

Further, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate.

<Photosensitive Layer>

Next, the photosensitive layer will be explained.

A layered photosensitive layer is formed of a CGL and a CTL which are sequentially layered.

<CGL>

The CGL is a layer including a CGM. The CGM includes at least the complex azo pigment for use in the present invention.

The complex azo pigment for use in the present invention is prepared by dissolving and de-carbo esterifying an azo compound having a carbo-ester group and the following formula (I):

$$A(E)n \quad (I)$$

wherein A represents a residue of an azo compound, bonded with n pieces of E group through one or more heteroatom being N or O and forming a part of the residue A; E independently represents a hydrogen atom or a carbo-ester group having a formula of —C(═O)—O—R1 wherein R1 represents a substituted or an unsubstituted alkyl group having 4 to 10 carbon atoms, an alkenyl group, an alkynyl group, a cycloalkyl group, a cycloalkenyl group or an aralkyl group; and n represents an integer of from 1 to 9 to prepare an azo compound having the following formula (a):

$$A(H)n \quad (a)$$

wherein A represents a residue of an azo compound, bonded with n pieces of hydrogen atom through one or more heteroatom being N or O and forming a part of the residue A; H represents a hydrogen atom; and n represents an integer of from 1 to 9; and adding another pigment thereto.

The complex azo pigment may be prepared by dissolving the azo compound having the formula (I) and a pigment to coexist therein, and chemically, thermally or photolytically de-carbo esterifying the azo compound having the formula (I) to prepare the azo compound having the following formula (a).

Two or more of the azo compound having the formula (I) may be chemically, thermally or photolytically de-carbo esterified at the same time or in a stepwise manner.

Azo compounds preferably used in the present invention include an azo compound having the formula (I) and an azo compound having the formula (a) in which A has the following formula (II):

$$B—(N═N—Cp)m \quad (II)$$

wherein B represents a main backbone of an azo compound; Cp represents a coupler component residue; and m represents an integer of 2 or 3.

The Cp is preferably at least anyone of compounds having the following formulae (1) to (9):

(1)

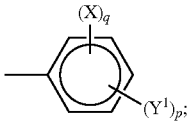

-continued (2)

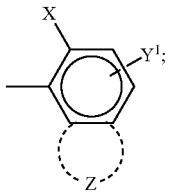

(3)

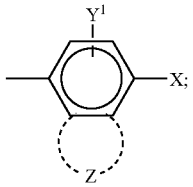

(4)

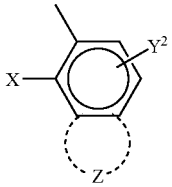

wherein X represents —OH, —N($R^1$)($R^2$) or —$NHSO_2$—$R^3$ wherein $R^1$ and $R^2$ independently represents a hydrogen atom or a substituted or an unsubstituted alkyl group, and R3 represents a substituted or an unsubstituted alkyl group or a substituted or an unsubstituted aryl group; $Y^1$ represents a hydrogen atom, a halogen atom, a substituted or an unsubstituted alkyl group, a substituted or an unsubstituted alkoxy group, a carboxy group, a sulfone group, a substituted or an unsubstituted sulfamoyl group or —CON($R^4$)($Y^2$) wherein $R^4$ represents an alkyl group or its substituents, or a phenyl group or its substituents, and $Y^2$ represents a ring hydrocarbon group or its substituents, a heterocyclic group or its substituents, or —N═C($R^5$)($R^6$) wherein $R^5$ represents a ring hydrocarbon group or its substituents, a heterocyclic group or its substituents, or a styryl group or its substituents, $R^6$ represents a hydrogen atom, an alkyl group, or a phenyl group or its substituents, and alternatively $R^5$ and $R^6$ optionally form a ring with carbon atoms bonded therewith; Z represents a ring hydrocarbon group or its substituents, or a heterocyclic group or its substituents; P represents an integer of 1 or 2; and q represents an integer of 1 or 2;

(5)

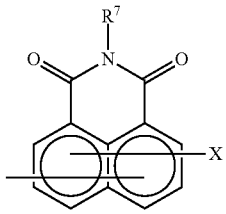

wherein $R^7$ represents a substituted or an unsubstituted hydrocarbon group; and X is same as the above-mentioned;

(6)

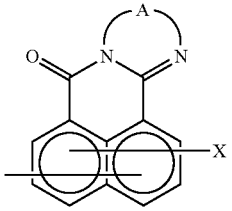

wherein A represents an of aromatic hydrocarbon bivalent group or a heterocyclic bivalent group including a nitrogen atom in the ring optionally substituted or unsubstituted; and X is same as the above-mentioned;

(7)

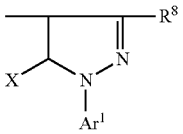

wherein $R^8$ represents an alkyl group, a carbamoyl group, a carboxy group or its esters; $Ar^1$ represents a ring hydrocarbon group or its substituents; and X is same as the above-mentioned;

(8)

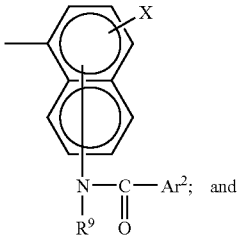

and (9)

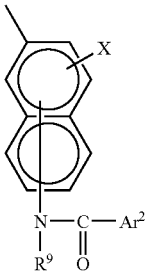

wherein $R^9$ represents a hydrogen atom, or a substituted or an unsubstituted hydrocarbon group; and $Ar^2$ a ring hydrocarbon group or its substituents.

The B in the formula (II) preferably has any one of the following formulae (III) to (X):

(III)

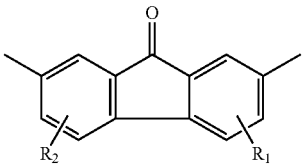

wherein $R_1$ and $R_2$ independently represent a hydrogen atom, a halogen atom, a substituted or an unsubstituted alkyl group, a substituted or an unsubstituted alkoxy group, and a carboxyl group and its esters;

(IV)

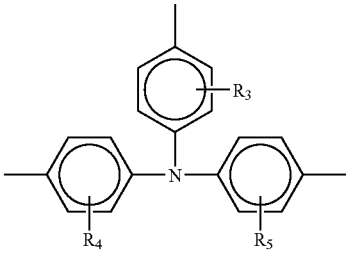

wherein $R_3$, $R_4$ and $R_5$ independently represent a hydrogen atom, a halogen atom, a substituted or an unsubstituted alkyl group, a substituted or an unsubstituted alkoxy group, and a carboxyl group and its esters;

(V)

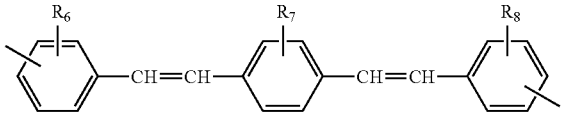

wherein $R_6$, $R_7$ and $R_8$ independently represent a hydrogen atom, a halogen atom, a substituted or an unsubstituted alkyl group, a substituted or an unsubstituted alkoxy group, and a carboxyl group and its esters;

(VI)

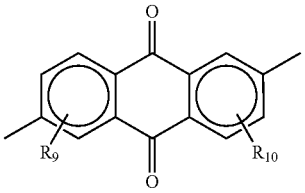

wherein $R_9$ and $R_{10}$ independently represent a hydrogen atom, a halogen atom, a substituted or an unsubstituted alkyl group, a substituted or an unsubstituted alkoxy group, and a carboxyl group and its esters;

(VII)

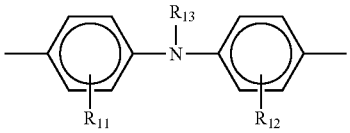

wherein $R_{11}$, $R_{12}$ and $R_{13}$ independently represent a hydrogen atom, a halogen atom, a substituted or an unsubstituted alkyl group, a substituted or an unsubstituted alkoxy group, and a carboxyl group and its esters;

(VIII)

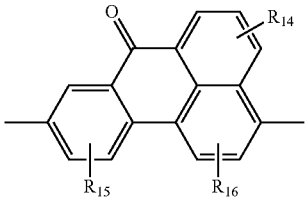

wherein $R_{14}$, $R_{15}$ and $R_{16}$ independently represent a hydrogen atom, a halogen atom, a substituted or an unsubstituted alkyl group, a substituted or an unsubstituted alkoxy group, and a carboxyl group and its esters;

(IX)

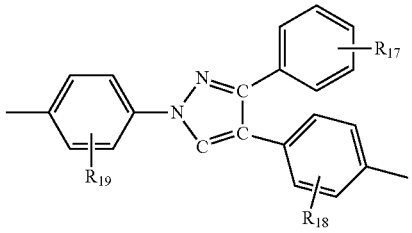

wherein $R_{17}$, $R_{18}$ and $R_{19}$ independently represent a hydrogen atom, a halogen atom, a substituted or an unsubstituted alkyl group, a substituted or an unsubstituted alkoxy group, and a carboxyl group and its esters; and (X)

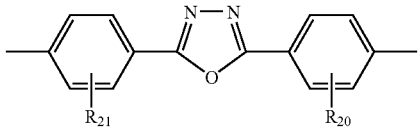

wherein $R_{21}$ and $R_{22}$ independently represent a hydrogen atom, a halogen atom, a substituted or an unsubstituted alkyl group, a substituted or an unsubstituted alkoxy group, and a carboxyl group and its esters.

Specific examples of the azo compounds having the formula III include compounds having the following formulae III-1 to III-14:

(III-1)

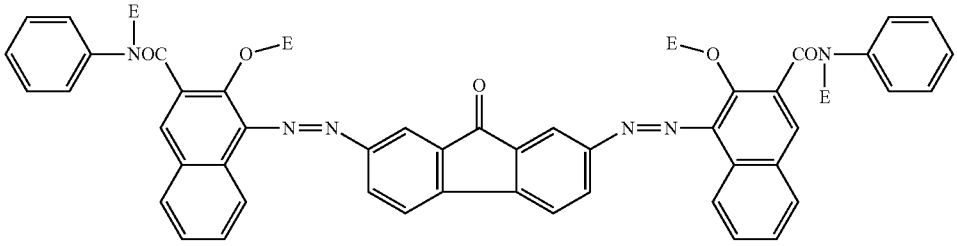

(III-2)

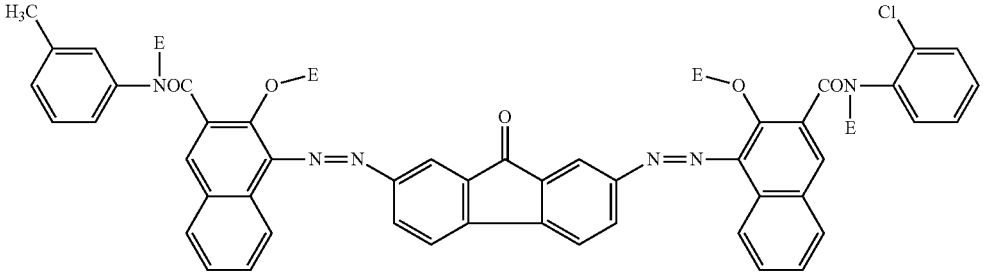

(III-3)

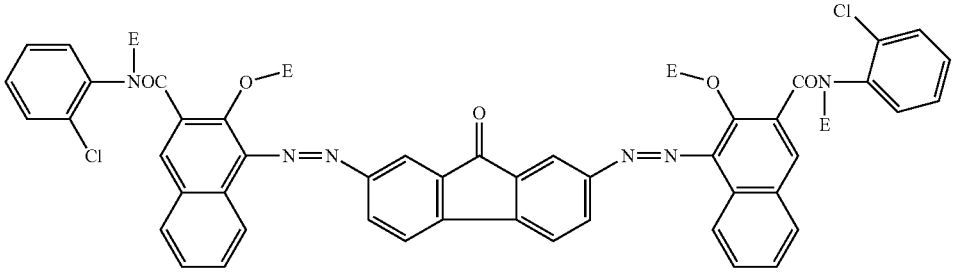

-continued
(III-4)
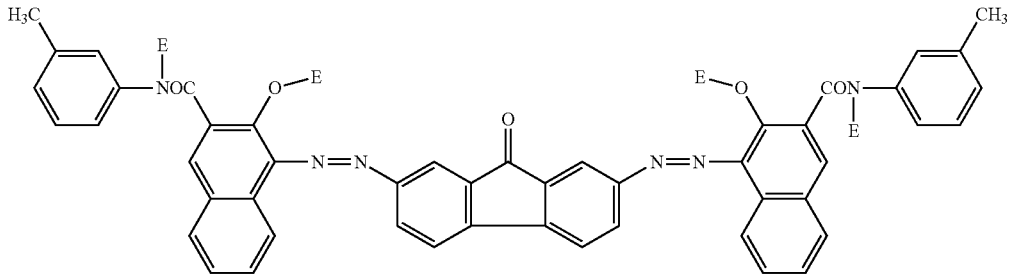
(III-5)
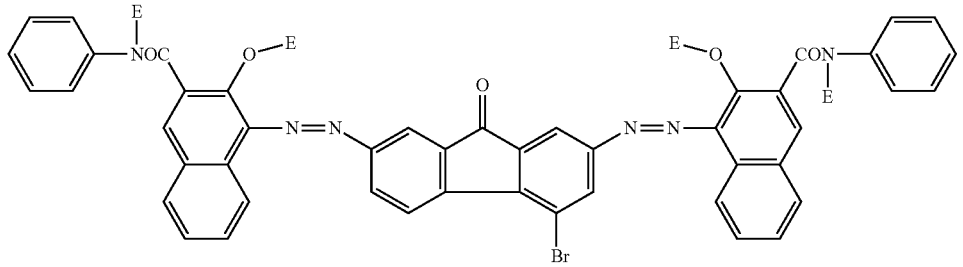
(III-6)
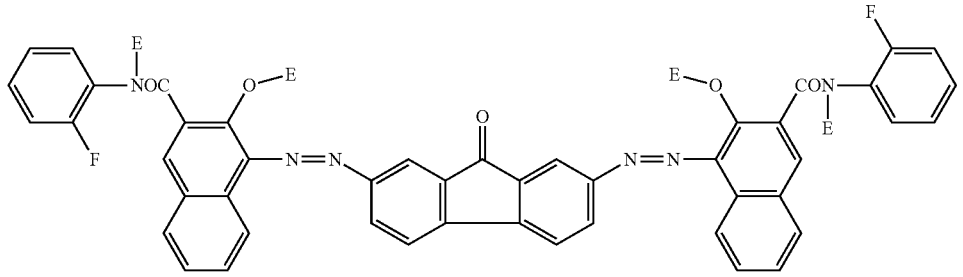
(III-7)
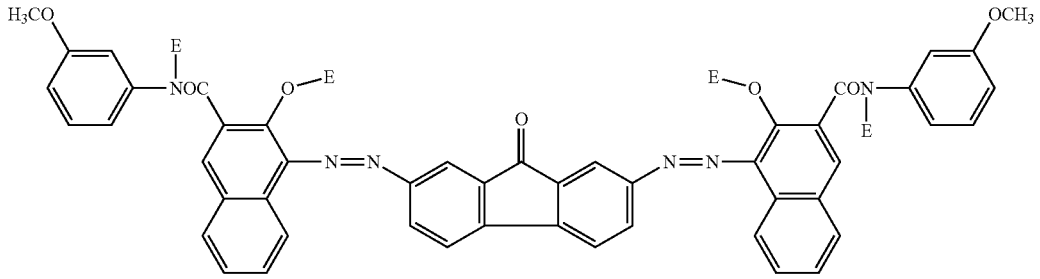
(III-8)
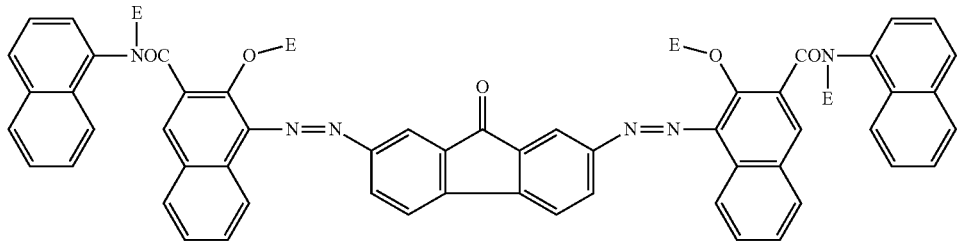

-continued
(III-9)
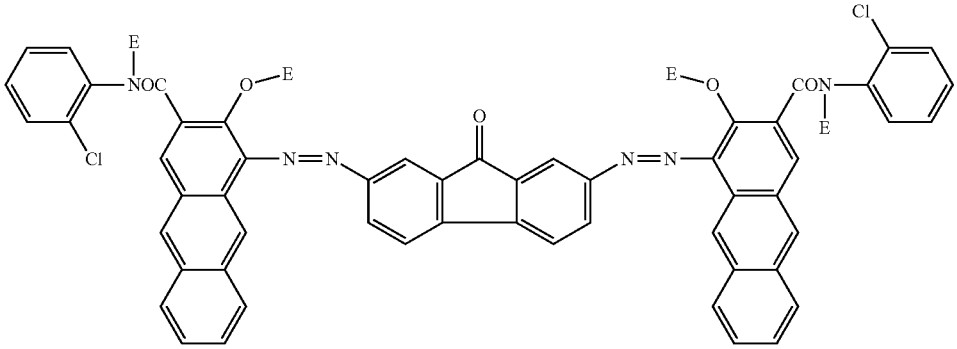
(III-10)
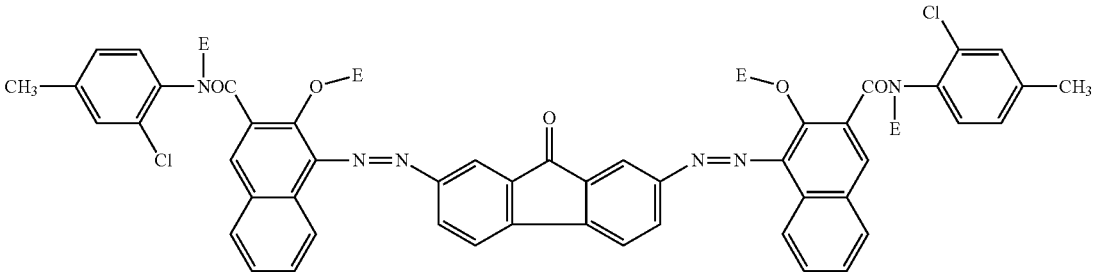
(III-11)
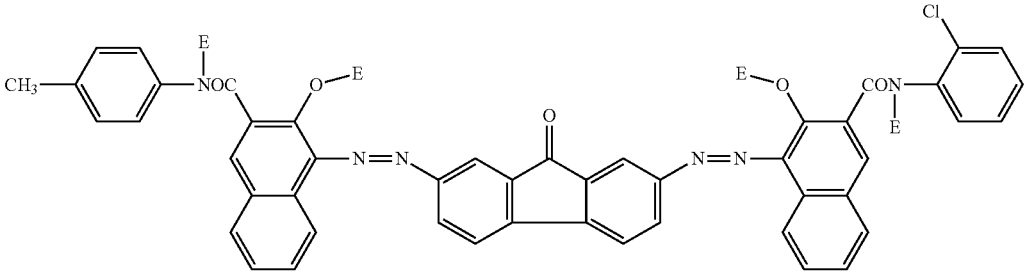
(III-12)
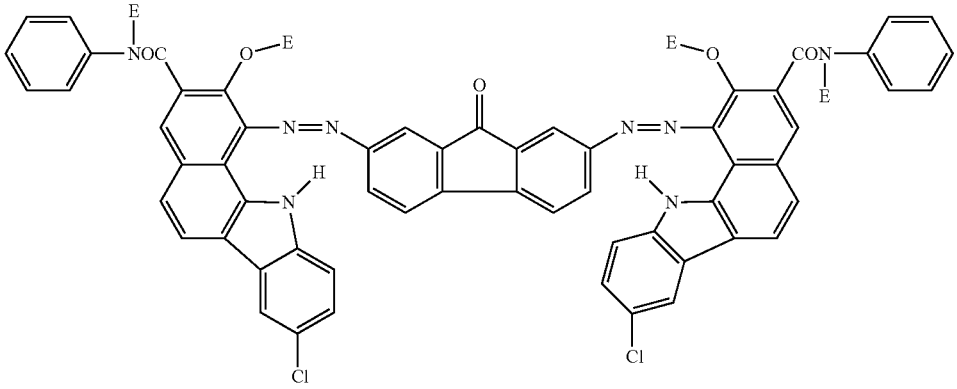

-continued
(III-13)
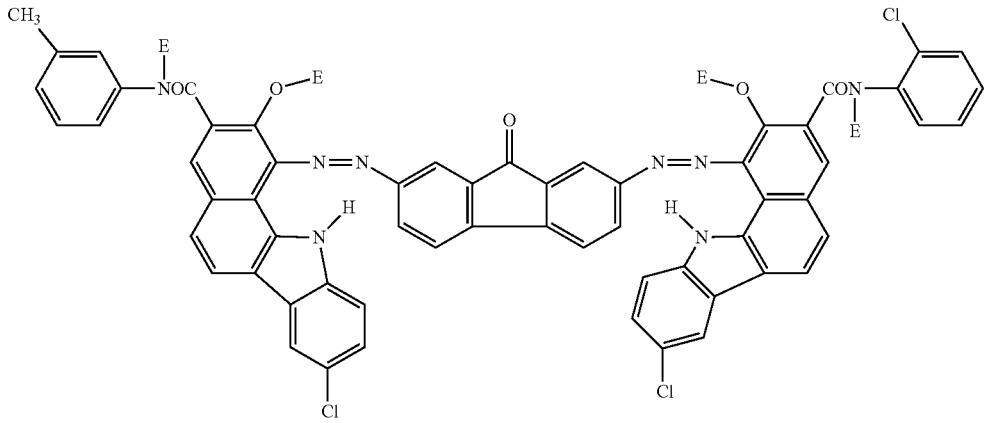
(III-14)
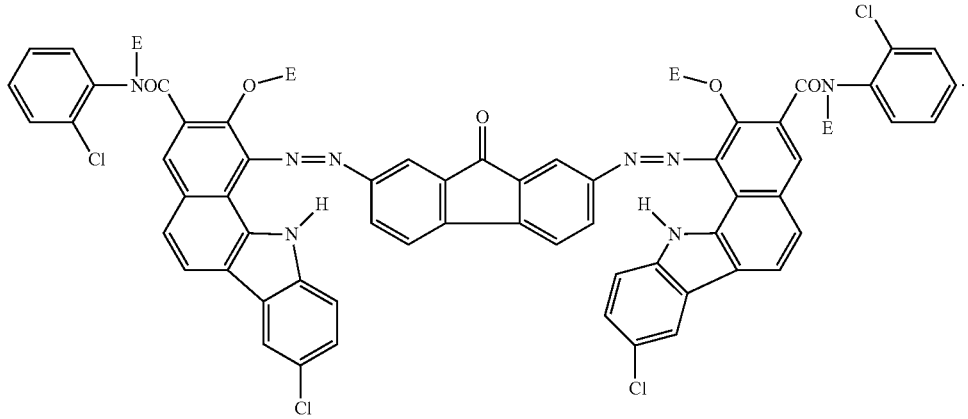
Specific examples of the azo compounds having the formula IV include compounds having the following formulae IV-1 to IV-5:
(IV-1)
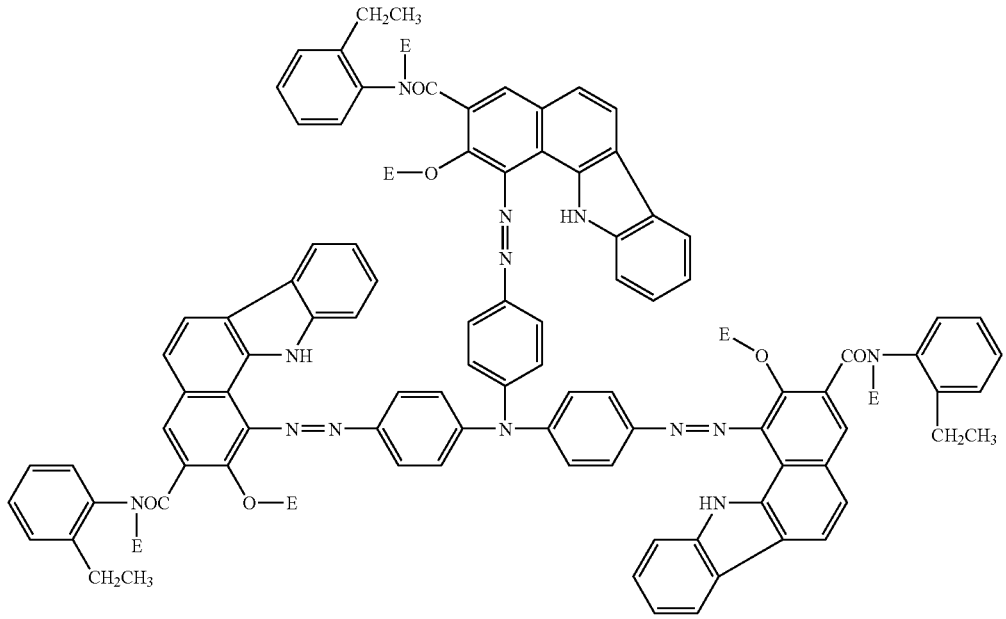

-continued
(IV-2)
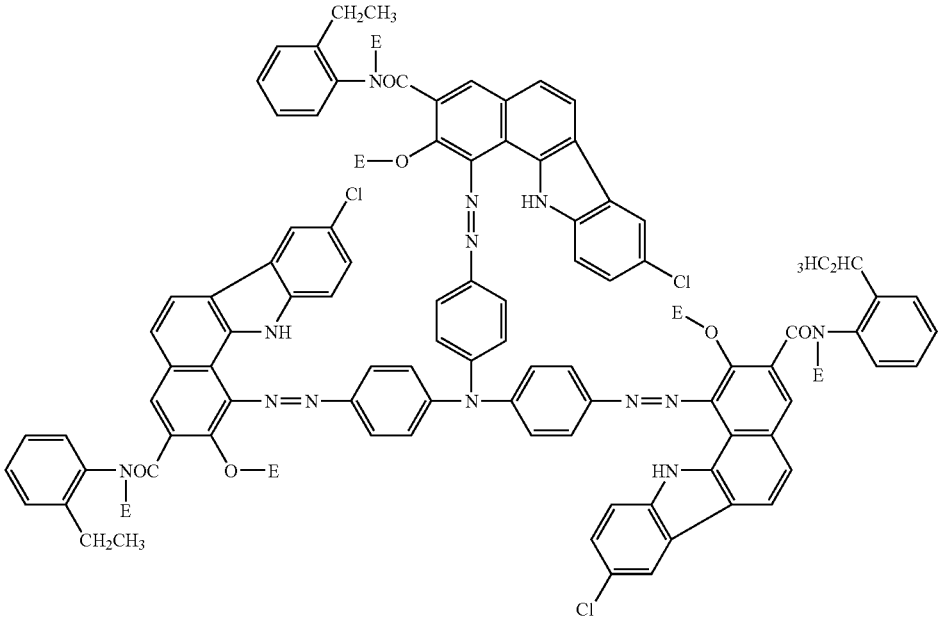
(IV-3)
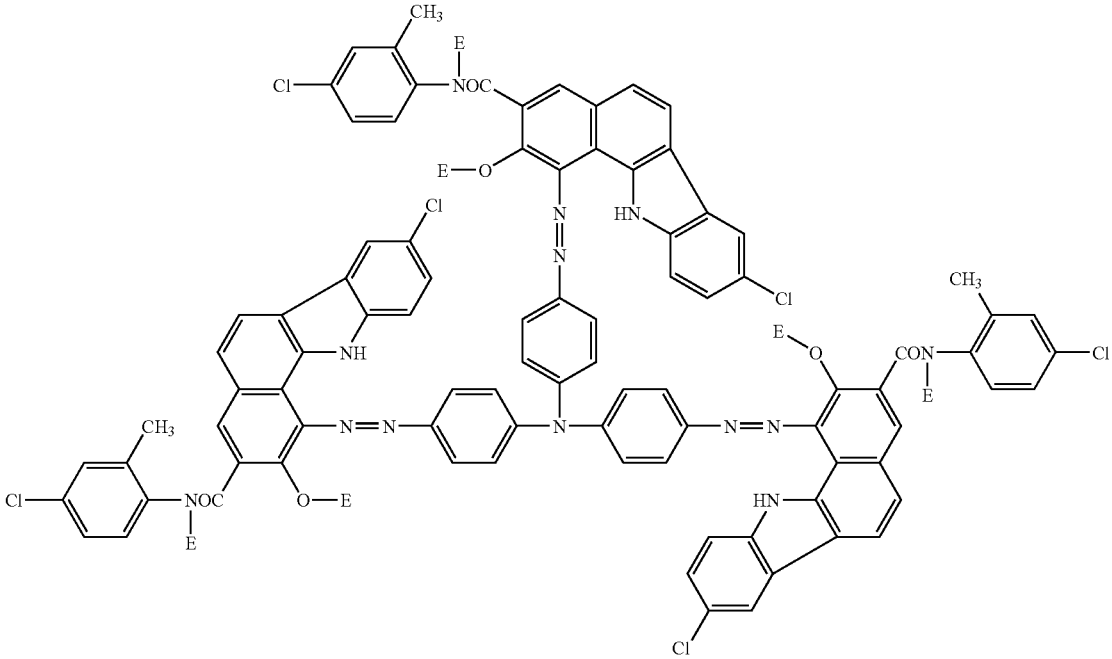

-continued
(IV-4)
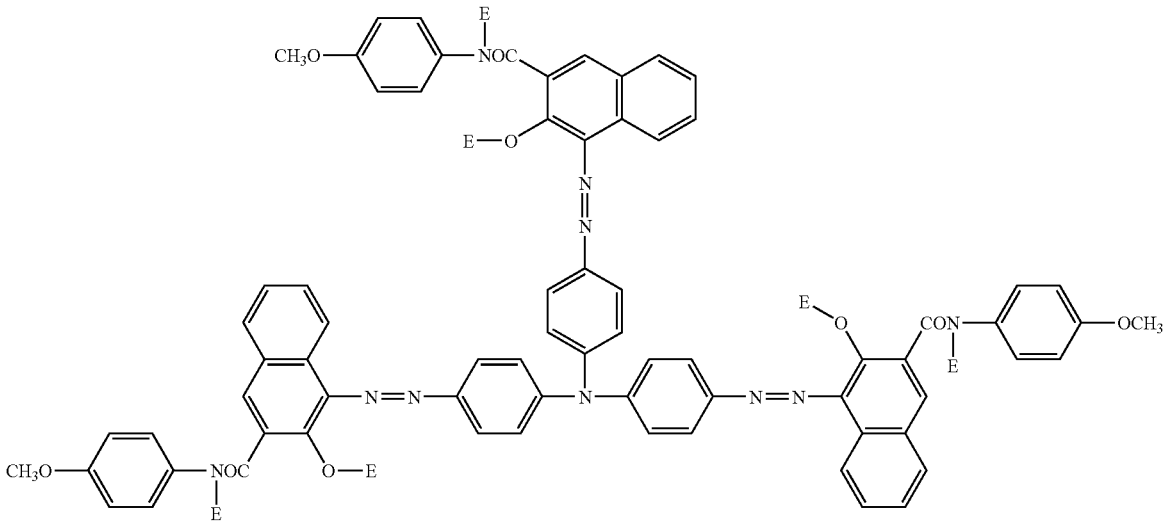
(IV-5)
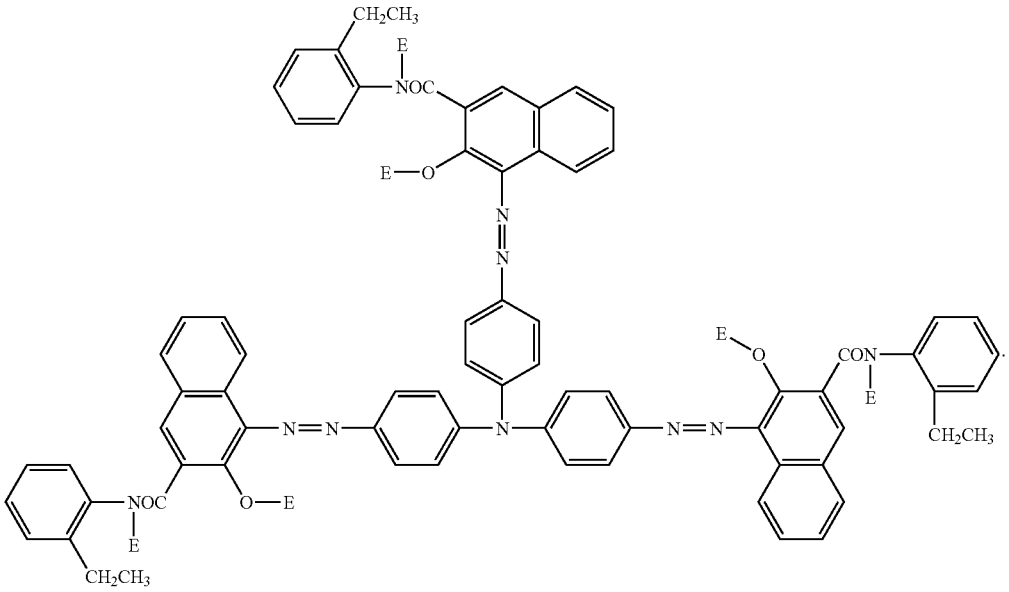
Specific examples of the azo compounds having the formula V include compounds having the following formulae V-1 to V-8:
(V-1)
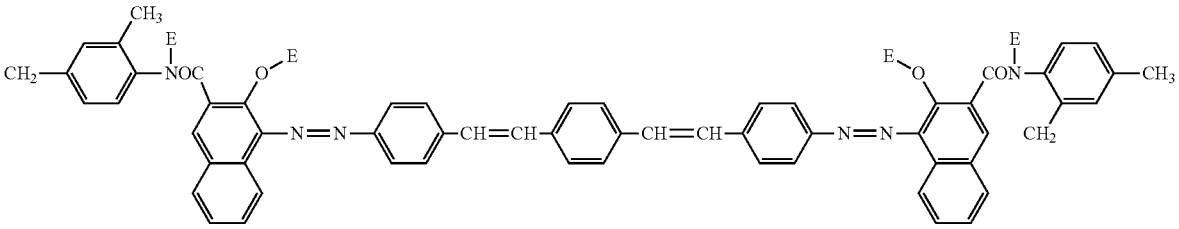

-continued
(V-2)
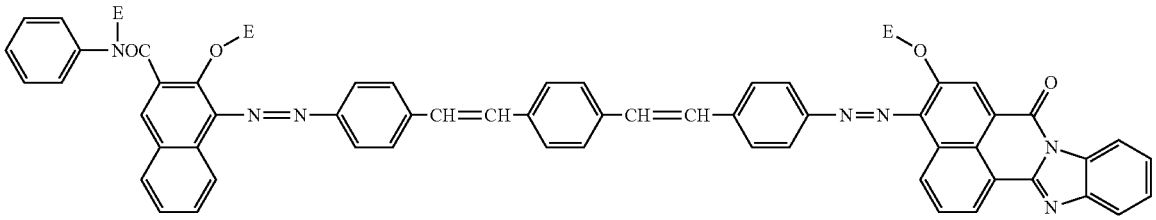
(V-3)
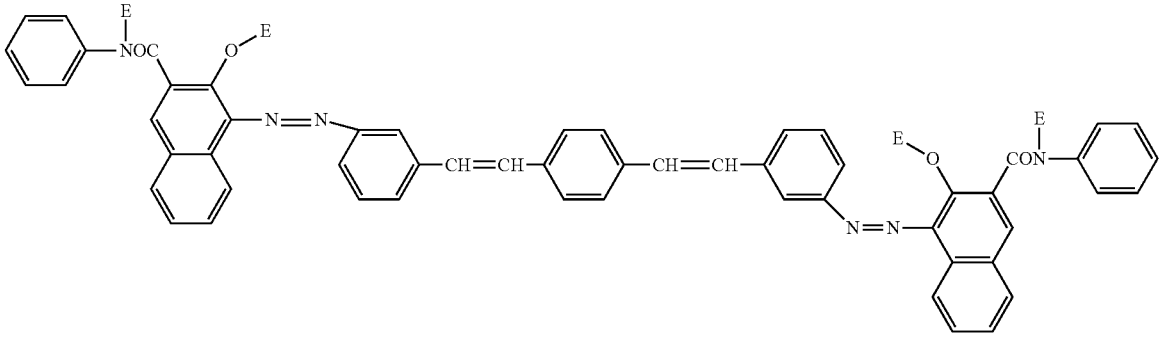
(V-4)
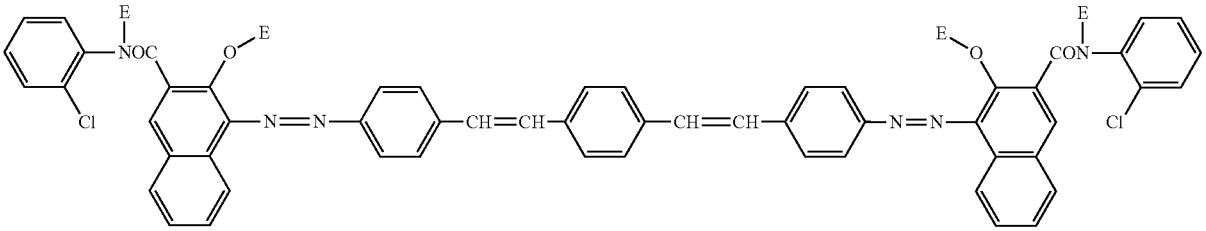
(V-5)
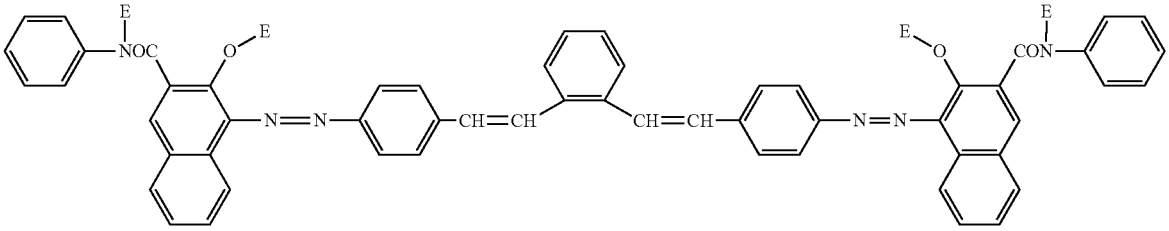
(V-6)
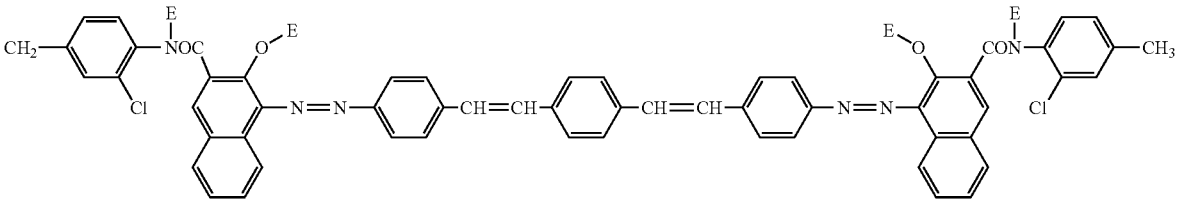
(V-7)
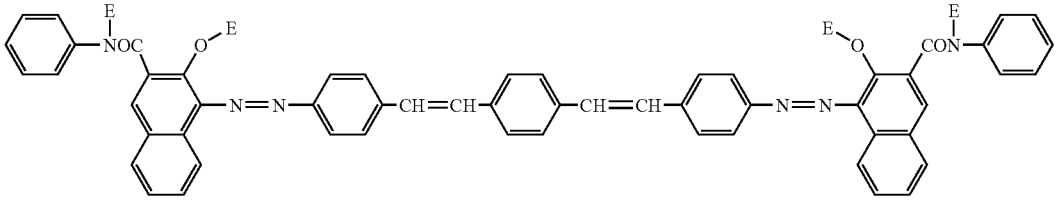

-continued
(V-8)
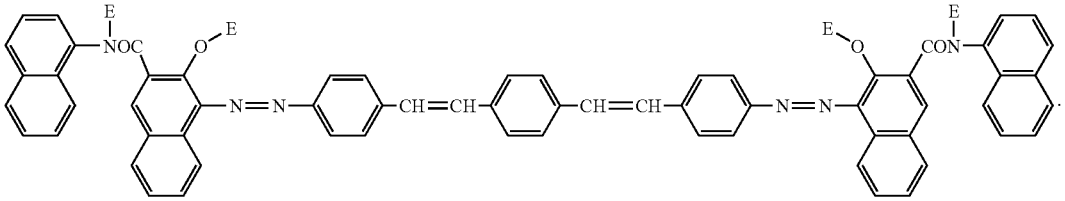
Specific examples of the azo compounds having the formula VI include compounds having the following formulae VI-1 to VI-5:
(VI-1)
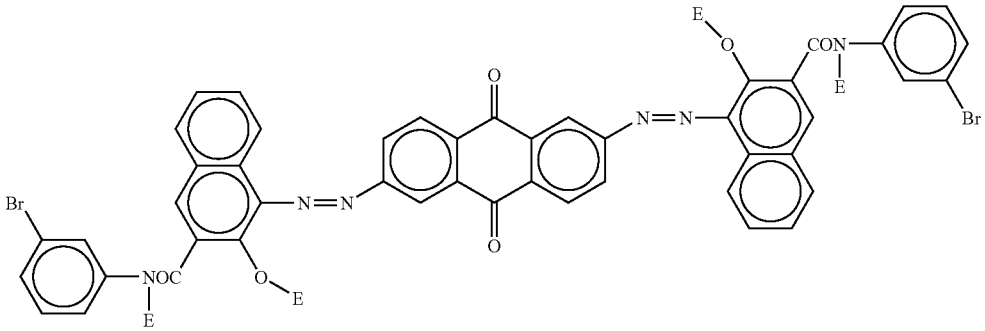
(VI-2)
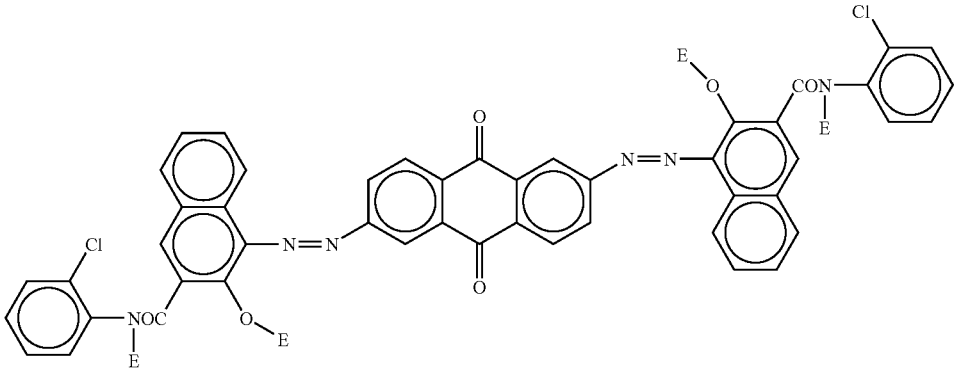
(VI-3)
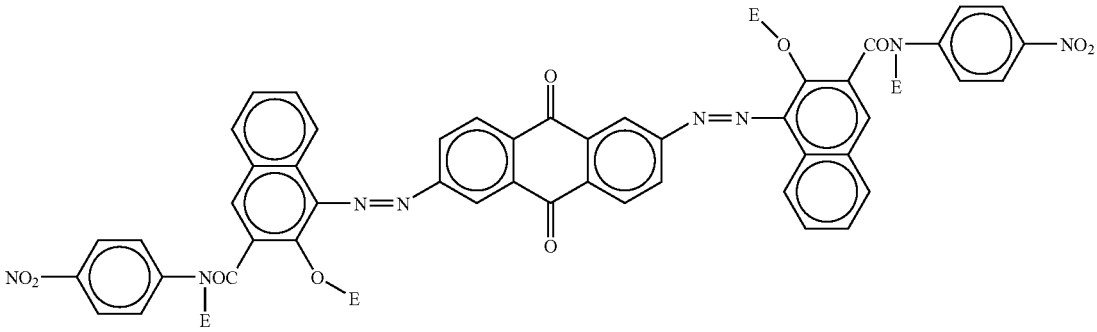

-continued
(VI-4)
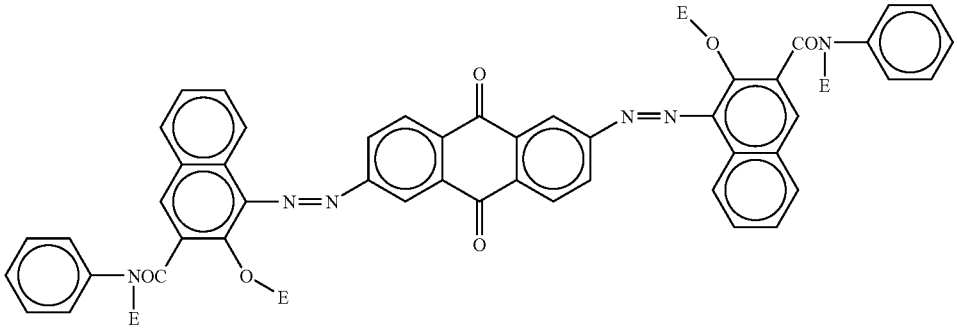
(VI-5)
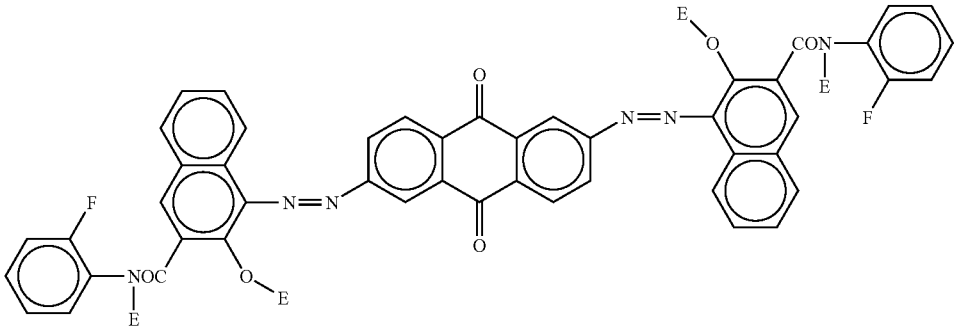
Specific examples of the azo compounds having the formula VII include compounds having the following formulae VII-1 to VII-7:
(VII-1)
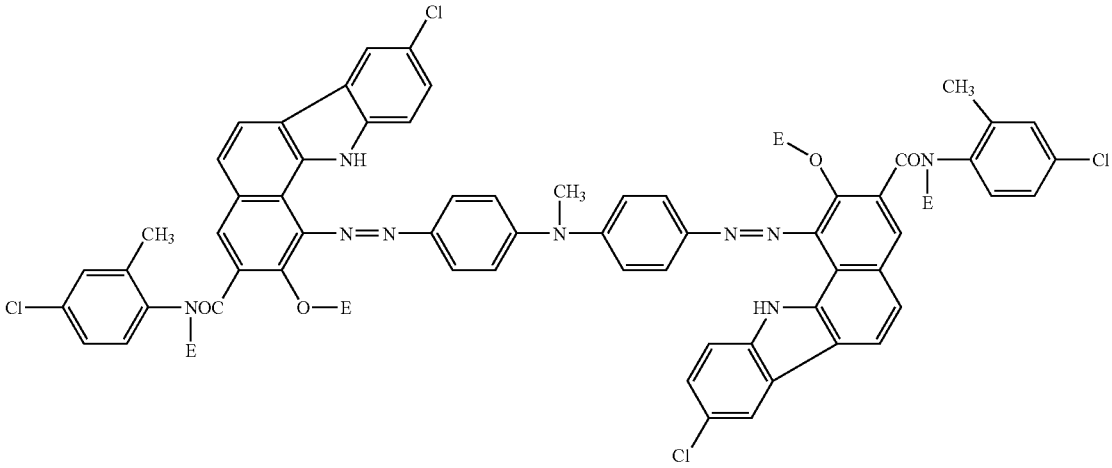
(VII-2)
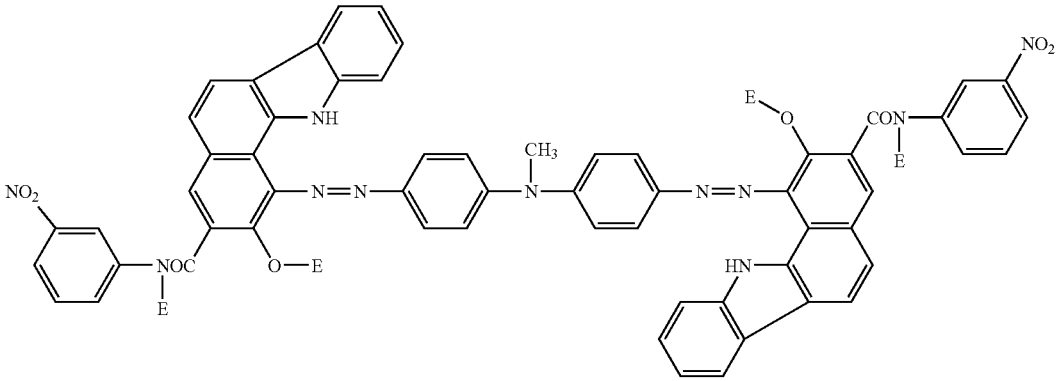

-continued
(VII-3)
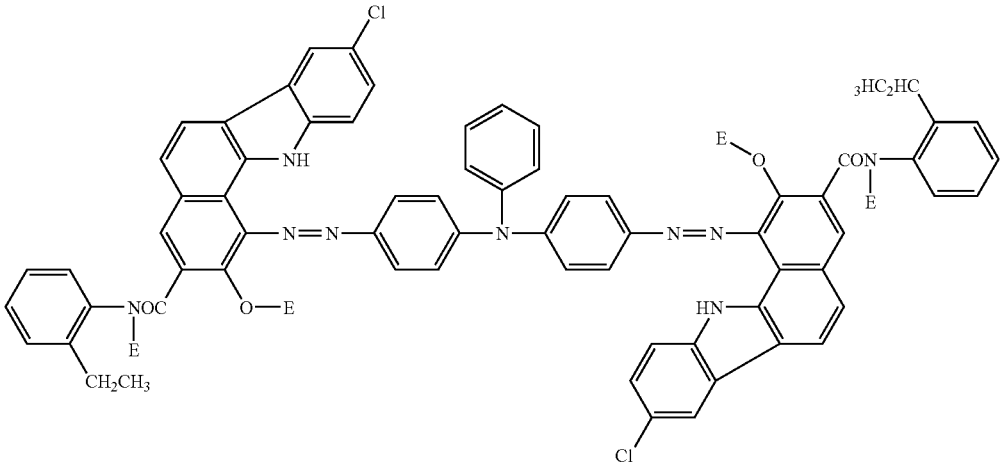
(VII-4)
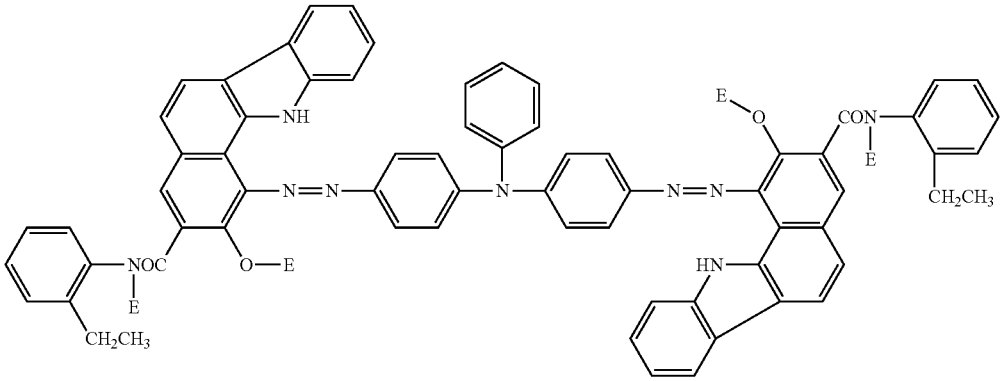
(VII-5)
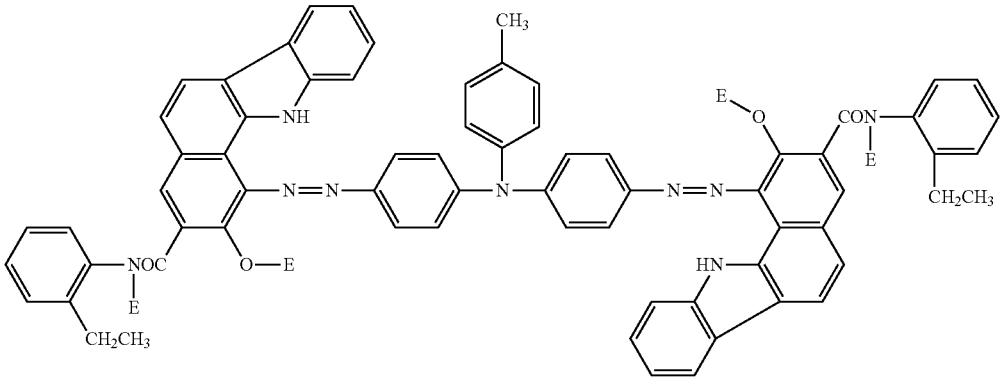
(VII-6)
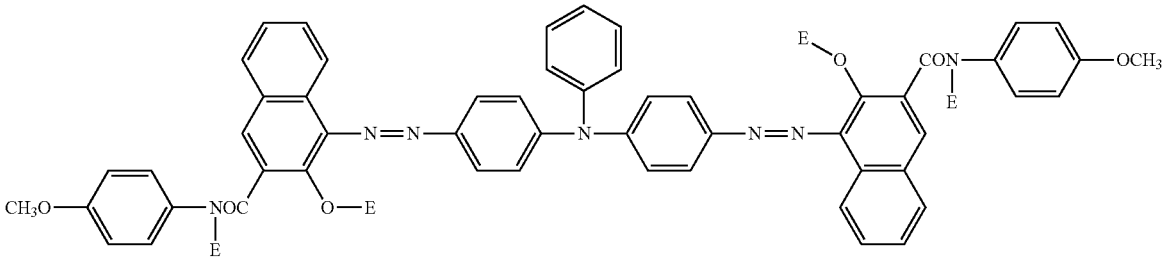

-continued
(VII-7)
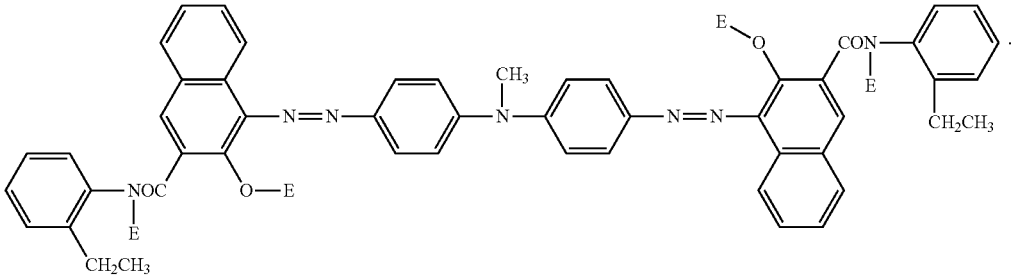
Specific examples of the azo compounds having the formula VIII include compounds having the following formulae VIII-1 to VIII-5:
(VIII-1)
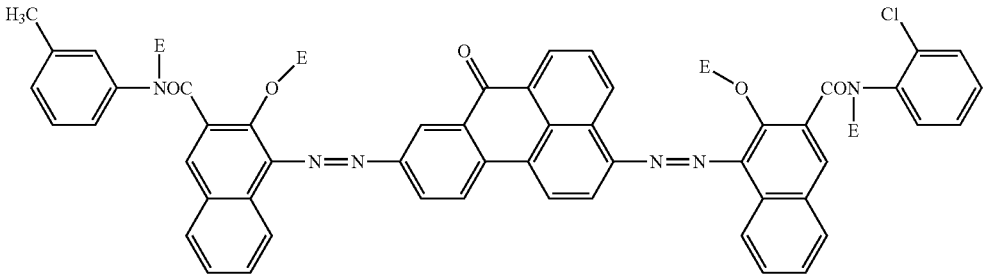
(VIII-2)
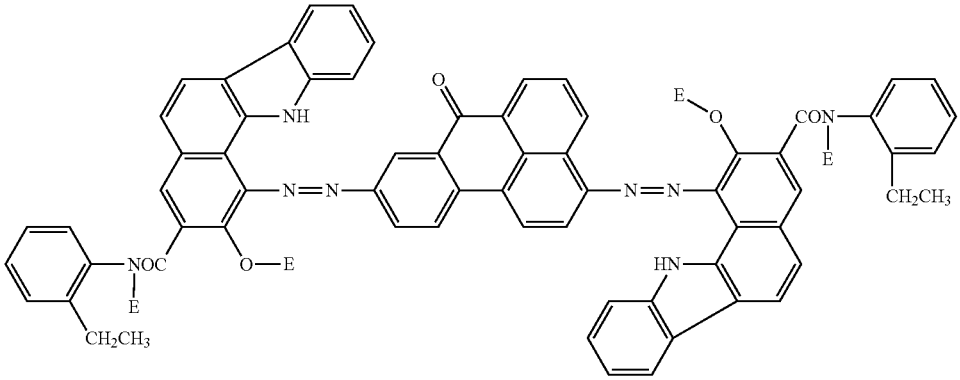
(VIII-3)
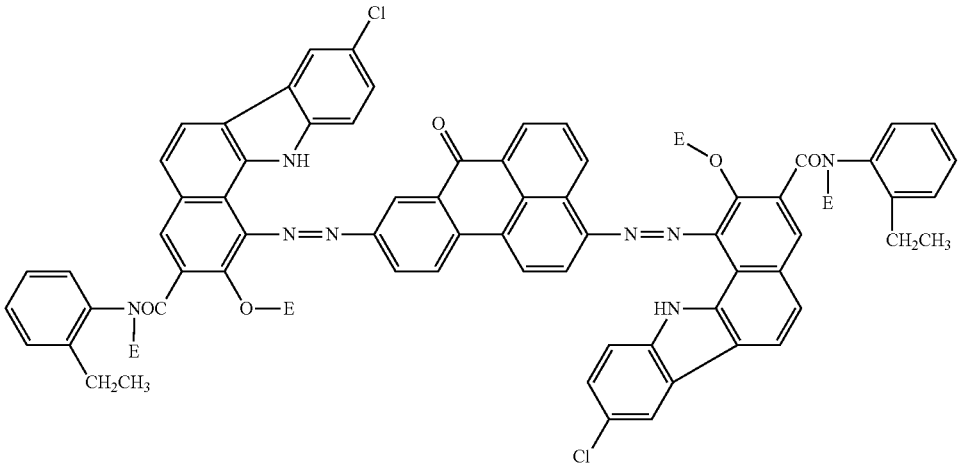

-continued
(VIII-4)
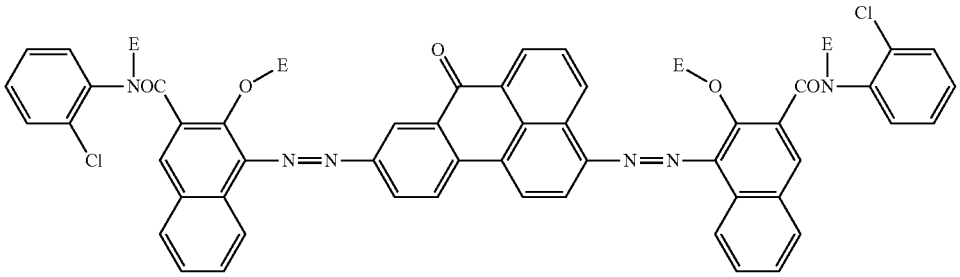
(VIII-5)
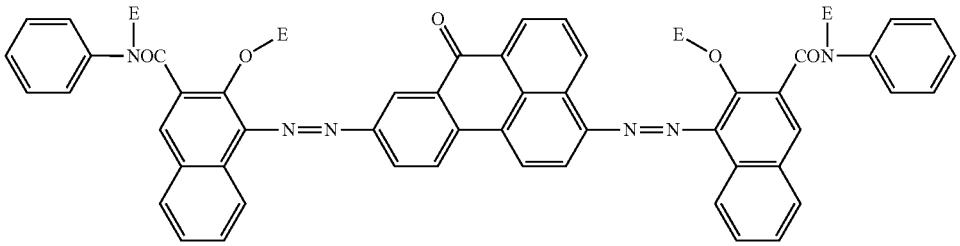
Specific examples of the azo compounds having the formula IX include compounds having the following formulae IX-1 to IX-4:
(IX-1)
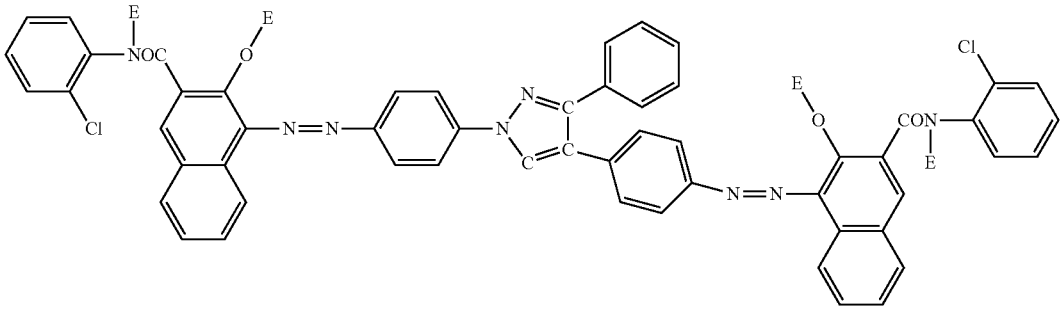
(IX-2)
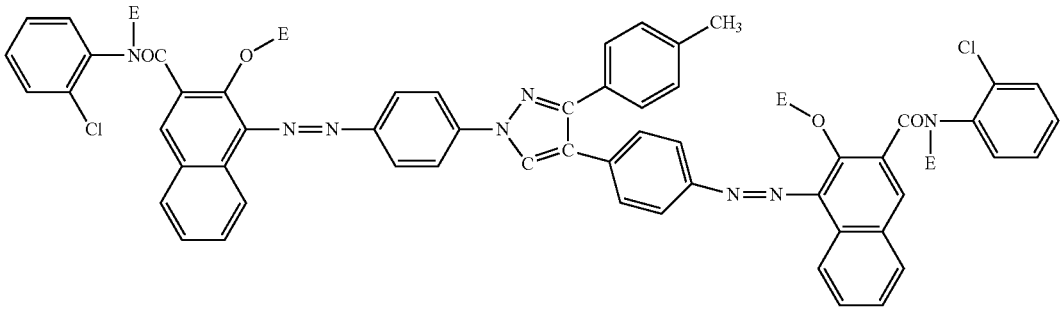
(IX-3)
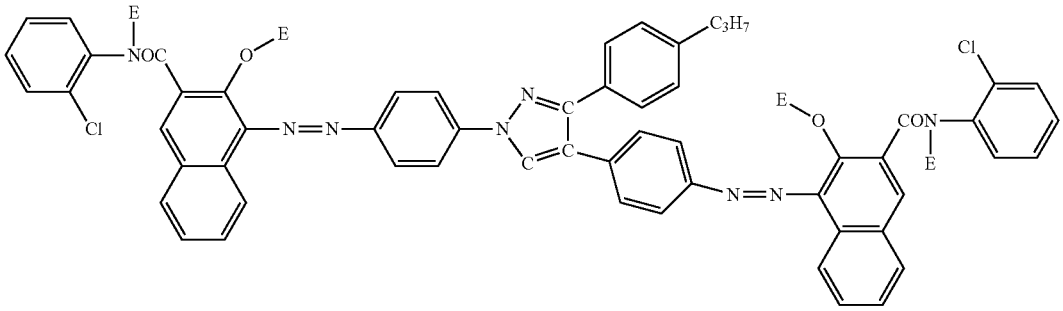

-continued
(IX-4)
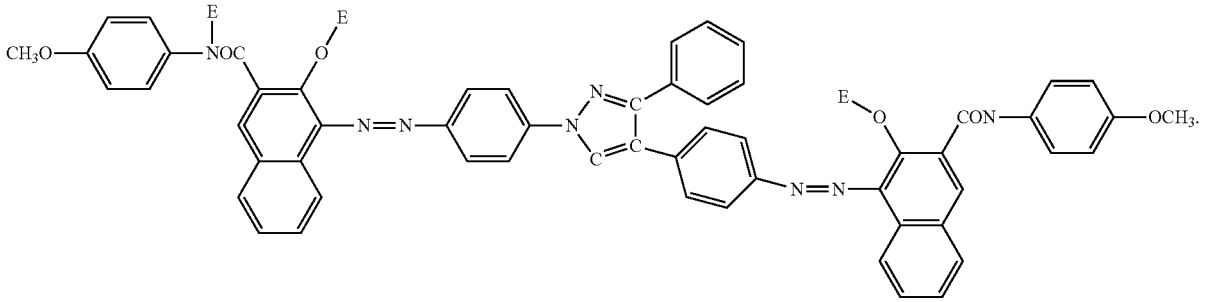
Specific examples of the azo compounds having the formula X include compounds having the following formulae X-1 to X-6:
(X-1)
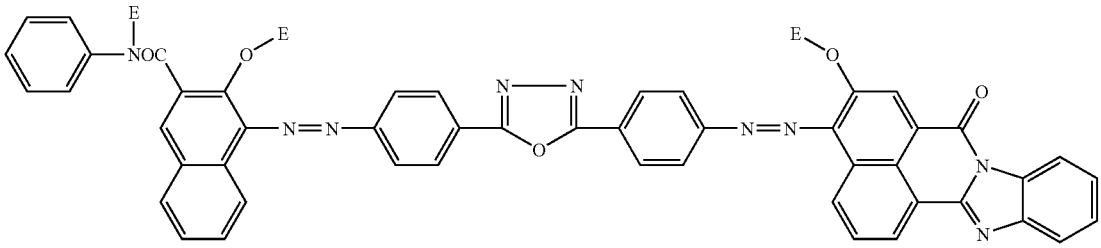
(X-2)
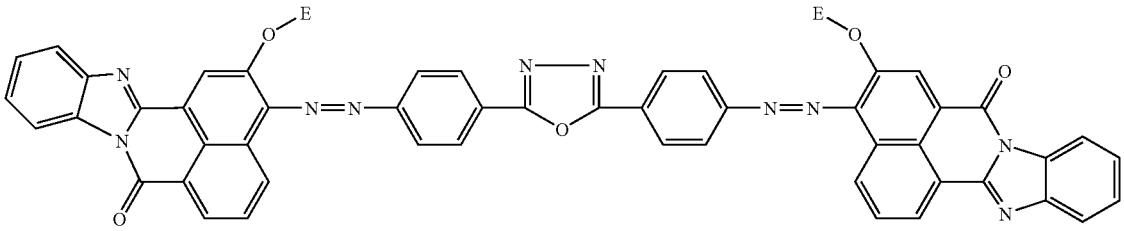
(X-3)
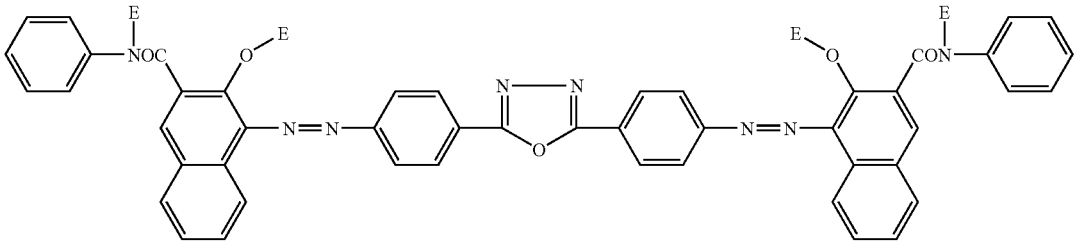
(X-4)
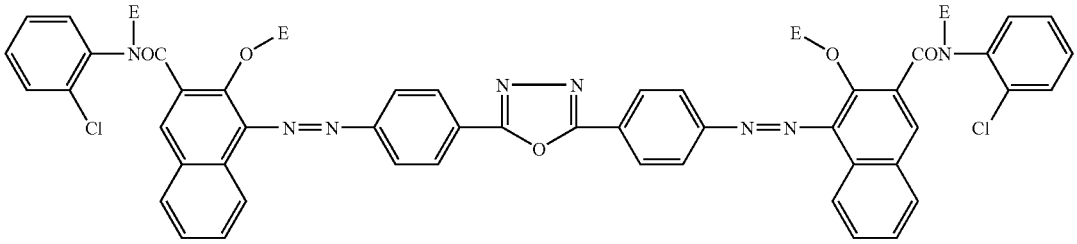

-continued (X-5)

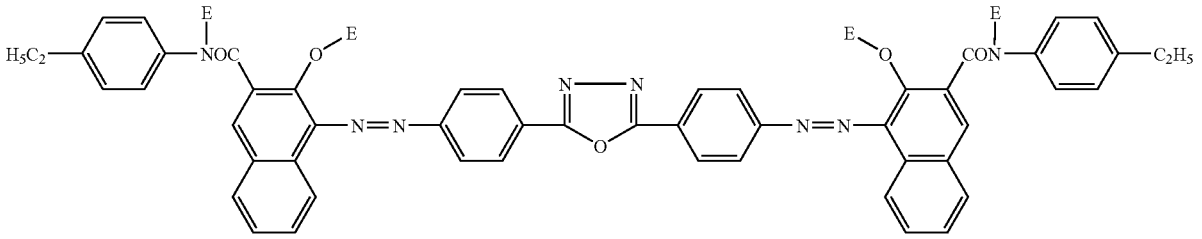

(X-6)

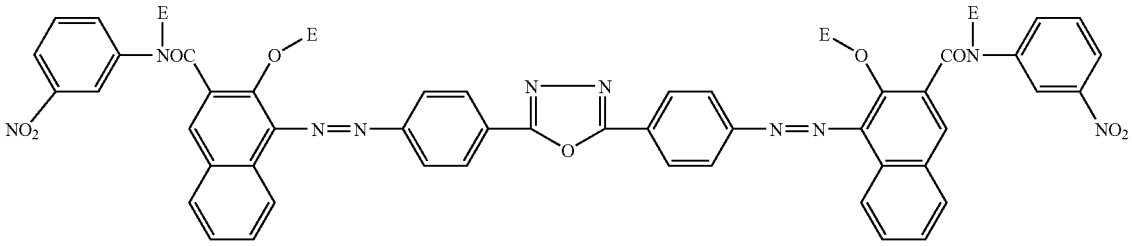

The compound having the formula (I) can be synthesized as disclosed in European Patents Nos. 648,770 and 648,817, or International Publication No. WO98/32802, e.g., the compound having the formula (II) and a compound having the following formula (10) are reacted each other at a proper molar ratio in an aprotic organic solvent at from 0 to 150° C., preferably from 10 to 100° C. for 30 min to 20 hrs under the presence of a base as a catalyst.

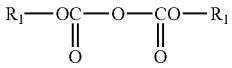

(10)

wherein $R_1$ represents a hydrogen atom, a substituted or an unsubstituted alkyl group having 4 to 10 carbon atoms, alkenyl group, alkynyl group, cycloalkyl group, cycloalkenyl group or aralkyl group.

The molar ratio depends on the number of E. Diester pyrocarbonate is preferably used a little bit more.

Specific examples of the aprotic organic solvent include ether solvents such as tetrahydrofuran and dioxane; glycol ether solvents such as ethyleneglycolmethylether and ethyleneglycolethylether; acetonitrile; N,N-dimethylformamide; N,N-dimethylacetoamide; ethylcellosolve; ethylacetate; methylacetate; dichloromethane; dichloroethane; monochlorobenzene; toluene; xylene; nitrobenzene; pyridine; picoline; quinoline; etc. Among these solvents, pyridine, tetrahydrofuran, N,N-dimethylformamide and N,N-dimethylacetoamide are preferably used.

Specific examples of the base as a catalyst include alkali metals such as sodium, kalium, and their hydroxides and carbonates; alkali metal amides such as sodium amide and kalium amide; and hydrogenated alkali metals such as hydrogenated lithium; organic aliphatic, aromatic or heterocyclic N-bases such as diazabicyclooctene, diazabicycloundecene, 4-dimethylaminopyridine, dimethylpyridine, pyridine and triethylamine. Among these bases, organic N-bases such as 4-dimethylaminopyridine, dimethylpyridine and pyridine are preferably used.

Diester pyrocarbonate having the formula (10) can be prepared by known methods, and commercially available.

Specific examples of the other pigments different from the azo compound having the formula (1) include azo pigments such as monoazo pigments, disazo pigments, asymmetric disazo pigments, trisazo pigments; phthalocyanine pigments such as titanylphthalocyanine, copper phthalocyanine, vanadyl phthalocyanine, hydroxy gallium phthalocyanine and metal-free phthalocyanine; perylene pigments; perynone pigments; indigo pigments; pyrrolo pyrrole pigments; anthraquinone pigments; quinacridone pigments; quinone condensed polycyclic compounds; squarylium pigments; etc. In addition, fullerene and carbon nanotube can also be used. Further, inorganic nano pigments such as zinc oxide, titanium oxide, silicon, silicon oxide, selenium, cadmium sulfide and cadmium selenide can also be used.

The pigments are preferably microscopic particles because their combinations interact each other on the molecular level. Specifically, the pigments preferably have a particle diameter 1 micron or less, and more preferably 0.5 micron or less.

Among these pigments, the phthalocyanine pigments are preferably used. The azo compounds having the formulae (III), (VI) and (VIII) are preferably combined with the phthalocyanine pigments. Titanylphthalocyanine, copper phthalocyanine, hydroxy gallium phthalocyanine, chloro gallium phthalocyanine, metal-free phthalocyanine, chloro indium phthalocyanine, etc. are preferably used, and titanylphthalocyanine is more preferably used. These are known to have good sensitivity even when used alone, and have higher sensitivity when combined with an azo compound having an electron absorbing structure by the method of the present invention.

A combination of two or more azo compounds having the formula (I) for use in the present invention, which are dissolved, mixed and de-carbo esterified to prepare a complex azo pigment is preferably a combination of a pigment having a P-type semiconductor or electron releasing structure or a substituent and a pigment having a N-type semiconductor or electron absorbing structure or a substituent because the combination interacts each other on the molecular level.

The azo pigment having the formula (III), (VI) or (VIII) which is thought to have N-type semiconductor properties and the azo pigment having the formula (IV) or (VII) which is thought to have P-type semiconductor properties are more preferably combined.

In addition, azo pigments having an electron absorbing substituent such as a nitro group, a cyano group or a chloro atom and azo pigments having an electron releasing substituent such as a methoxy group and a methyl group are also preferably combined.

A method of dissolving and de-carbo esterifying a second azo compound having a carbo-ester group and the following formula (I):

$$A(E)n \quad (I)$$

wherein A represents a residue of an azo compound, bonded with n pieces of E group through one or more heteroatom being N or O and forming a part of the residue A; E independently represents a hydrogen atom or a carbo-ester group having a formula of —C(═O)—O—R1 wherein R1 represents a substituted or an unsubstituted alkyl group having 4 to 10 carbon atoms, an alkenyl group, an alkynyl group, a cycloalkyl group, a cycloalkenyl group or an aralkyl group; and n represents an integer of from 1 to 9 to prepare an azo compound having the following formula (a):

$$A(H)n \quad (a)$$

wherein A represents a residue of an azo compound, bonded with n pieces of hydrogen atom through one or more heteroatom being N or O and forming apart of the residue A; H represents a hydrogen atom; and n represents an integer of from 1 to 9.

Other pigments coexisting with the azo compounds having the formula (I) include phthalocyanine pigments, condensed polycyclic pigments, fullerene, carbon nanotube and inorganic nano pigments.

The chemical methods include using an acid or a base as a catalyst to prepare an azo pigment. Acids such as ethyl acetate, trifluoroacetic acid, propionic acid, acrylic acid, benzoic acid, hydrochloric acid, sulfuric acid, boracic acid, p-toluene sulfonic acid and salicylic acid are preferably used as a catalyst.

The thermal methods include heating at from 50 to 300° C. under the presence of a solvent to prepare an azo pigment, and preferably heating at from 70 to 250° C. under atmospheric pressure for 30 min to 20 hrs.

The photolytical method can use light the azo compound having the formula (I) can absorb. Specifically, high-pressure or low-pressure mercury lamps, tungsten lamps, LED lamps, laser light sources, etc. can be used.

Specific examples of the organic solvent include ether solvents such as tetrahydrofuran and dioxane; glycol ether solvents such as ethyleneglycolmethylether and ethyleneglycolethylether; acetonitrile; N,N-dimethylformamide; N,N-dimethylacetoamide; ethylcellosolve; ethylacetate; methylacetate; dichloromethane; dichloroethane; monochlorobenzene; toluene; xylene; nitrobenzene; pyridine; picoline; quinoline; etc.

Combinations of the chemical methods, thermal methods and photolytical methods can more efficiently prepare a complex azo pigment. Particularly, a combination of the chemical methods and the thermal methods can prepare a high-purity complex azo pigment at higher yield.

When the azo compound having the formula (I) and another pigment different therefrom are coexistently combined, the pigment is preferably miniaturized in advance. The pigment is preferably miniaturized by mechanical pulverization methods, precipitaion methods, miniaturization from air phase methods, etc. to have a diameter of 0.5 μm or less.

The pigment is added to a solution in which the azo compound having the formula (I) is dissolved in an organic solvent and stirred so that the azo compound can be present with the pigment on the molecular level, which is de-carbo esterified by chemical, thermal or photolytical means to prepare the complex azo pigment of the present invention.

When two or more of the azo compound having the formula (I) are mixed, dissolved and de-carbo esterified to prepare a complex azo pigment, a solution in which the two or more of the azo compound having the formula (I) is dissolved in an organic solvent is stirred so that the azo compound can be present on the molecular level, which is de-carbo esterified by chemical, thermal or photolytical means to prepare the complex azo pigment of the present invention. Depending on the de-carbo esterifying conditions and azo compounds, a pigment having a core-shell structure can be formed by selectively quickening a reaction speed of a specific azo compound.

In the present invention, a solution in which the azo compound having the formula (I) is dissolved in an organic solvent is preferably subjected to an absorption treatment with a silica gel, alumina, florisil, an active carbon, an active earth, a diatom earth or perlite.

Specific examples of the organic solvent include ether solvents such as tetrahydrofuran and dioxane; glycol ether solvents such as ethyleneglycolmethylether and ethyleneglycolethylether; acetonitrile; N,N-dimethylformamide; N,N-dimethylacetoamide; ethylcellosolve; ethylacetate; methylacetate; dichloromethane; dichloroethane; monochlorobenzene; toluene; xylene; nitrobenzene; pyridine; picoline; quinoline; and their combinations. The absorption treatment includes column chromatography and filtration with an absorbent at room temperature or when heated. In addition, a combination of the absorption treatment and a recrystallization can more efficiently prepare an azo pigment.

Specific examples of binder resins used in the CGL include polyamide, polyurethane, epoxy resins, polyketone, polycarbonate, silicone resins, acrylic resins, polyvinylbutyral, polyvinylformal, polyvinylketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, etc. The CGL preferably includes the binder resin in an amount of from 0 to 500 parts by weight, and preferably from 10 to 300 parts by weight, per 100 parts by weight of the charge generation material therein.

In the present invention, the binder resins and their contents in a CGL coating liquid can be more freely determined because the phthalocyanine pigment covered by the azo pigment has high crystal stability in the complex azo pigment of the present invention, which is a combination of an azo compound and a phthalocyanine pigment. Conventionally, a specific amount or more of binder resins have been necessary to maintain crystallinity of the phthalocyanine pigment, but only a small amount thereof is necessary to maintain crystal stability of the complex phthalocyanine pigment. Therefore, charge accumulation due to the presence of the binder resin can be prevented, and the resultant photoreceptor improves in properties.

The CGL is formed by dispersing a CGM with a binder resin when necessary in a proper solvent by a ball mill, an attritor, a sand mill or an ultrasound to prepare a dispersion; and coating and drying the dispersion on an electroconductive substrate, an undercoat layer or an intermediate layer. The binder resin may be added before or after the CGM is dispersed.

Specific examples of the solvents used for forming the CGL include isopropanol, acetone, methyl ethyl ketone, cyclohexanone, tetrahydrofuran, dioxane, ethylcellosolve, ethylacetate, methylacetate, dichloromethane, dichloroethane, monochlorobenzene, cyclohexane, toluene, xylene, ligroin, etc. Among these, ketone solvents, ester solvents and ether solvents are preferably used. These can be used alone or in combination.

A CGL coating liquid includes a CGM, a solvent and a binder resin as main components, and may include any additives such as a sensitizer, a dispersant, a surfactant and a silicone oil.

The coating liquid can be coated by known coating methods such as dip coating, spray coating, bead coating, nozzle coating, spinner coating and ring coating methods.

The CGL preferably has a thickness of from 0.01 to 5 μm, and more preferably from 0.1 to 2 μm. The CGL is heated and dried by an oven, etc. The CGL is preferably heated at from 50 to 160° C., and more preferably from 80 to 140° C.

<CTL>

Next, the CTL will be explained.

The CTL can be formed by dissolving or dispersing a CTM and a binder resin in a proper solvent coating the coating liquid on the CGL and drying the coated liquid. Additives such as plasticizers, leveling agents, antioxidants and lubricants can optionally be included in the coating liquid alone or in combination.

Specific examples of the CTM include materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These CTMs can be used alone or in combination.

The CTL preferably includes the CTM in an amount of from 20 to 300 parts by weight, and more preferably from 40 to 150 parts by weight per 100 parts by weight of the binder resin.

Specific examples of the binder resin include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

Suitable solvents for use in the coating liquid include tetrahydrofuran, dioxane, toluene, dichloromethane, monochlorobenzene, dichloroethane, cyclohexanone, methyl ethyl ketone, acetone, diethylether, etc. These can be used alone or in combination.

The CTL preferably has a thickness of from 10 to 50 μm, and more preferably from 15 to 35 μm in terms of image resolution and responsivity.

The coating liquid can be coated by known coating methods such as dip coating, spray coating, bead coating, nozzle coating, spinner coating and ring coating methods. The CTL needs to have a specific thickness and is preferably coated by the dip coating method in a liquid having high viscosity.

The CTL is heated and dried in an oven, etc. after coated. The drying temperature is preferably from 80 to 160° C., and more preferably from 110 to 140° C., although depending on the solvent included in the coating liquid. The CTL is preferably dried for 10 min or longer, and more preferably 20 min or longer.

<Single-Layered Photosensitive Layer>

A photoreceptor may have only one photosensitive layer having both charge generatability and charge transportability, in which the CGM and the CTM are dispersed or dissolved in a binder resin.

A CGM, a CTM and a binder resin are dissolved or dispersed in a solvent such as tetrahydrofuran, dioxane, dichloroethane, methyl ethyl ketone, cyclohexane, cyclohexanone, toluene and xylene to prepare a coating liquid; and applying the coating liquid to an electroconductive substrate by conventional methods such as dip coating, spray coating, bead coating, and ring coating methods to form the photosensitive layer thereon.

The CTM preferably includes both a positive-hole transport material and an electron transport material. The photosensitive layer, may include a plasticizer, a leveling agent, an antioxidant, etc. when necessary.

Any materials included in the CGL and CTL can be used for the CGM, CTL, binder resin, organic solvents, additives for use in the single-layered photosensitive layer.

A mixture of the binder resins used in the CTL and those used in the CGL may be used for the binder resins for use in the single-layered photosensitive layer. The photosensitive layer preferably includes a CGM in an amount of from 5 to 40 parts by weight, more preferably from 10 to 30 parts by weight per 100 parts by weight of the binder resin. The photosensitive layer preferably includes a CTM in an amount of from 0 to 190 parts by weight, more preferably from 50 to 150 parts by weight per 100 parts by weight of the binder resin. The photosensitive layer preferably has a thickness of from 5 to 40 μm, and more preferably from 10 to 30 μm.

<Undercoat Layer>

In the photoreceptor of the present invention, an undercoat layer may be formed between the electroconductive substrate and the CGL.

The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins and epoxy resins.

The undercoat layer may include a fine powder of metal oxides such as titanium oxide, silica, alumina, zirconium oxide, tin oxide and indium oxide to prevent occurrence of moiré in the resultant images and to decrease residual potential of the photoreceptor.

The undercoat layer can also be formed by coating a coating liquid using a proper solvent and a proper coating method similarly to those for use in format ion of the CGL ad CTL mentioned above. The undercoat layer may be formed using a silane coupling agent, titanium coupling agent or a chromium coupling agent.

<Protection Layer>

In the present invention, the photoreceptor may have a protection layer on the outermost surface to improve abrasion resistance. Any known protection layers such as polymeric CTM layers, filler-dispersion layers and hardened layers can be used in the present invention.

<Image Forming Apparatus>

Next, the electrophotographic method and image forming apparatus of the present invention of the present invention will be explained in detail.

Figure 5:
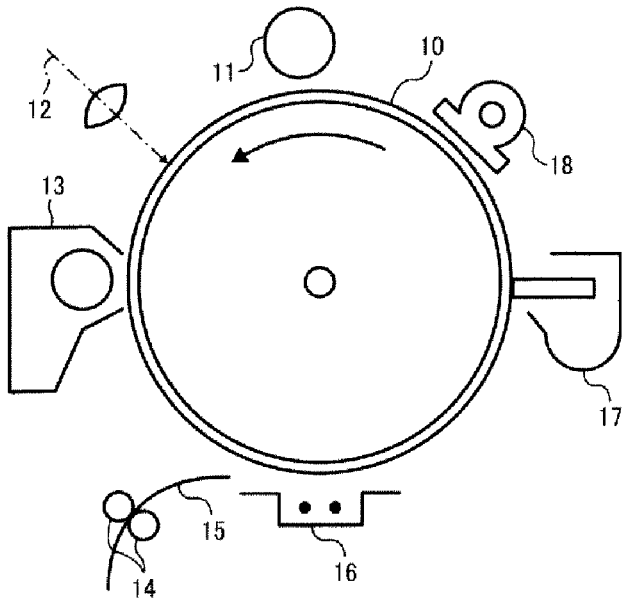
FIG. 5 is a schematic view illustrating an embodiment of the electrophotographic process and image forming apparatus of the present invention.

FIG. 5 is a schematic view illustrating an embodiment of the electrophotographic process and image forming apparatus of the present invention, the following example belongs to the scope of the present invention.

Photoreceptor 10 rotates in the direction of an arrow in FIG. 5, and a charger 11, an imagewise light irradiator 12, an image developer 13, a transferer 16, a cleaner 17, a discharger 18, etc. are located around the photoreceptor 10. The leaner 17 and the discharger 18 can be omitted.

Image forming operation is basically made as follows. The surface of the photoreceptor 10 is uniformly charged by the charger 11. The imagewise light irradiator 12 irradiates the surface of the photoreceptor 10 with imagewise light to form an electrostatic latent image. The electrostatic latent image is developed by the image developer 13 to form a toner image on the surface of the photoreceptor. The toner image is transferred by the transferer 16 onto a transfer paper 15 fed to a transfer site by a feeding roller 14. The toner image is fixed on the transfer paper by a fixer (not shown). A toner untransferred onto the transfer paper is removed by the cleaner 17. A charge remaining on the photoreceptor is discharged by the discharger 18, and the next cycle follows.

In FIG. 5, the photoreceptor 10 has the shape of a drum, and may have the shape of a sheet or an endless belt. Known chargers such as corotrons, scorotrons, solid state chargers, charging rollers and charging brushes can be used for the charger 11 and the transferer 16.

Suitable light sources for the imagewise light irradiator 12 and the discharger 18 include general light-emitting materials such as fluorescent lamps, tungsten lamps, halogen lamps, mercury lamps, sodium lamps, LEDs, LDs, light sources using electroluminescence (EL), etc. Among these, LEDs and LDs are mostly used.

In addition, in order to obtain light having a desired wave length range, filters such as sharp-cut filters, band pass filters, near-infrared cutting filters, dichroic filters, interference filters, color temperature converting filters can be used.

The above-mentioned light sources can be used for not only the process illustrated in FIG. 5, but also other processes such as a transfer process, a discharging process, a cleaning process, a pre-exposure process include light irradiation to the photoreceptor 10. However, in the discharging process, the photoreceptor 10 is largely influenced by the irradiation, resulting in occasional deterioration of chargeability and increase of residual potential.

Therefore, a reverse bias is optionally applied in the charging process and cleaning process instead of irradiation to discharge, which improves durability of the photoreceptor.

When the photoreceptor positively (or negatively) charged is exposed to imagewise light, an electrostatic latent image having a positive (or negative) charge is formed on the photoreceptor. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained. As the developing method, known developing methods can be used.

Further, known discharging methods can be used as the discharging method.

Among contaminants adhering the surface of a photoreceptor, a discharge material generated by charging and an external additive in a toner are vulnerable to humidity and cause abnormal images. A paper powder is also one of materials causing abnormal images, and it adheres to a photoreceptor, incidentally resulting in not only production of abnormal images but also deterioration of abrasion resistance and sectional abrasion of the photoreceptor. Therefore, it is preferable that the photoreceptor does not directly contact a paper in terms of high quality images.

When a toner image formed on the photoreceptor 10 by the image developer 13 is transferred onto the transfer paper 15, all of the toner image is not transferred thereto, and a residual toner remains on the surface of the photoreceptor 10. The residual toner is removed from the photoreceptor by a fur brush or a cleaning blade. The residual toner remaining on the photoreceptor can be removed by only the brush or a combination with the blade. Suitable cleaning brushes include known cleaning brushes such as fur brushes and mag-fur brushes.

The photoreceptor of the present invention is very effectively used in a tandem-type image forming apparatus including plural photoreceptors for respective image developers parallely forming plural color toner images. The tandem-type image forming apparatus including at least 4 color toners, i.e., yellow (Y) magenta (M), cyan (C) and black (K), respective image developers holding them, and at least 4 photoreceptors therefor is capable of printing full-color images at very higher speed than conventional full-color image forming apparatuses.

Figure 6:
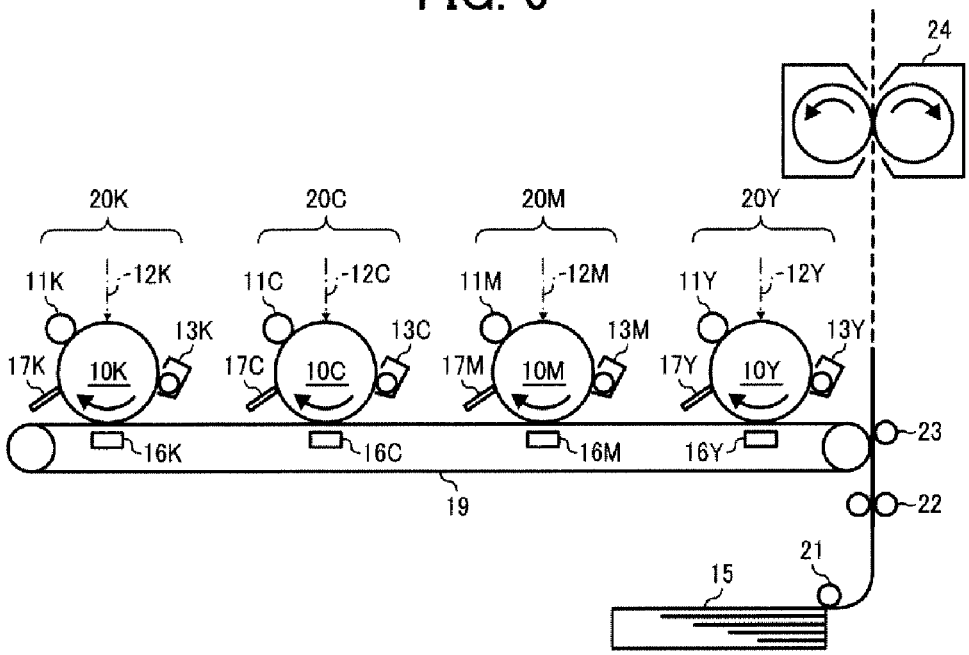
FIG. 6 is a schematic view illustrating the charger of the present invention.

FIG. 6 is a schematic view illustrating an embodiment of the tandem-type full-color image forming apparatus of the present invention, and the following modified embodiment is included in the present invention.

In FIG. 6, numerals 10C, 10M, 10Y and 10K represent drum-shaped photoreceptors of the present invention. The photoreceptors 10C, 10M, 10Y and 10K rotate in the direction indicated by an arrow, and around them, chargers 11C, 11M, 11Y and 11K; image developers 13C, 13M, 13Y and 13*k*; and cleaners 17C, 17M, 17Y and 17K are arranged in a rotation order thereof.

Laser beams 12C, 12M, 12Y and 12K from irradiators (not shown) irradiate the surfaces of the photoreceptors between the chargers 11C, 11M, 11Y and 11K and image developers 13C, 13M, 13Y and 13*k* to form electrostatic latent images on the surfaces of the photoreceptors 10C, 10M, 10Y and 10K.

Four image forming units 20C, 20M, 20Y and 20K including the photoreceptors 10C, 10M, 10Y and 10K are arranged along a transfer feeding belt 19 feeding a transfer material. The transfer feeding belt 19 contacts the photoreceptors 10C, 10M, 10Y and 10K between the image developers 13C, 13M, 13Y and 13*k* and cleaners 17C, 17M, 17Y and 17K of the image forming units 20C, 20M, 20Y and 20K. Transfer members 16*c*, 16M, 16Y and 16K are arranged on a backside of the transfer feeding belt 19, which is an opposite side to the photoreceptors, to apply a transfer bias to the transfer feeding belt 19. The image forming units 20C, 20M, 20Y and 20K just handle different color toners respectively, and have the same structures.

In the full-color electrophotographic apparatus in FIG. 6, images are formed as follows. First, in the image forming units 20C, 20M, 20Y and 20K, the photoreceptors 10C, 10M, 10Y and 10K are charged by the chargers 11C, 11M, 11Y and 11K rotating in the same direction of the photoreceptors. Next, the laser beams 12C, 12M, 12Y and 12K from irradiators (not shown) irradiate the surfaces of the photoreceptors to form electrostatic latent images having different colors respectively thereon.

Then, the image developers 13C, 13M, 13Y and 13*k* develop the electrostatic latent images to form toner images. The image developers 13C, 13M, 13Y and 13*k* develop the electrostatic latent images with toners having a cyan color C, a magenta color M, a yellow color Y and a black color K respectively. The color toner images respectively formed on the photoreceptors 10C, 10M, 10Y and 10K are overlaid on transfer feeding belt 19.

The transfer paper 15 is fed by a paper feeding roller 21 from a tray and stopped once by a pair of registration rollers 22, and fed onto a transfer member 23 in timing with formation of the toner images on the photoreceptors. The toner images held on the transfer feeding belt 19 are transferred to the transfer paper 15 by an electric field formed with a potential difference between the transfer bias applied by the transfer member 23 and the transfer feeding belt 19. The toner images transferred on the transfer paper is fixed thereon by a fixer 24 and the transfer paper 15 on which the toner images are fixed is fed onto a sheet receiver (not shown). Residual toners remaining on the photoreceptors 10C, 10M, 10Y and 10K, which were not transferred on the transfer paper at a transfer position are collected by the cleaners 17C, 17M, 17Y and 17K.

The intermediate transfer method as shown in FIG. 6 is effectively used for full-color image forming apparatuses in particular. After plural toner images are formed on the intermediate transferer, they are transferred onto a paper at a time to prevent shifted color, which produces images having higher quality.

Any known drum-shaped and belt-shaped intermediate transferers can be used in the present invention, and are effectively and efficiently used for higher durability of a photoreceptor or quality images having higher quality.

In FIG. 6, the image forming units are lined in order of C, M, Y and K from an upstream to a downstream of feeding direction of the transfer sheet. However, the order is not limited thereto and the color orders are optional. When only a black image is produced, the image forming units 20C, 20M, 20Y and 20K except for 20K can be stopped in the apparatus of the present invention.

The above-mentioned image forming units may be fixedly set in a copier, a facsimile or a printer. However, the image forming units may be set therein as a process cartridge.

Figure 7:
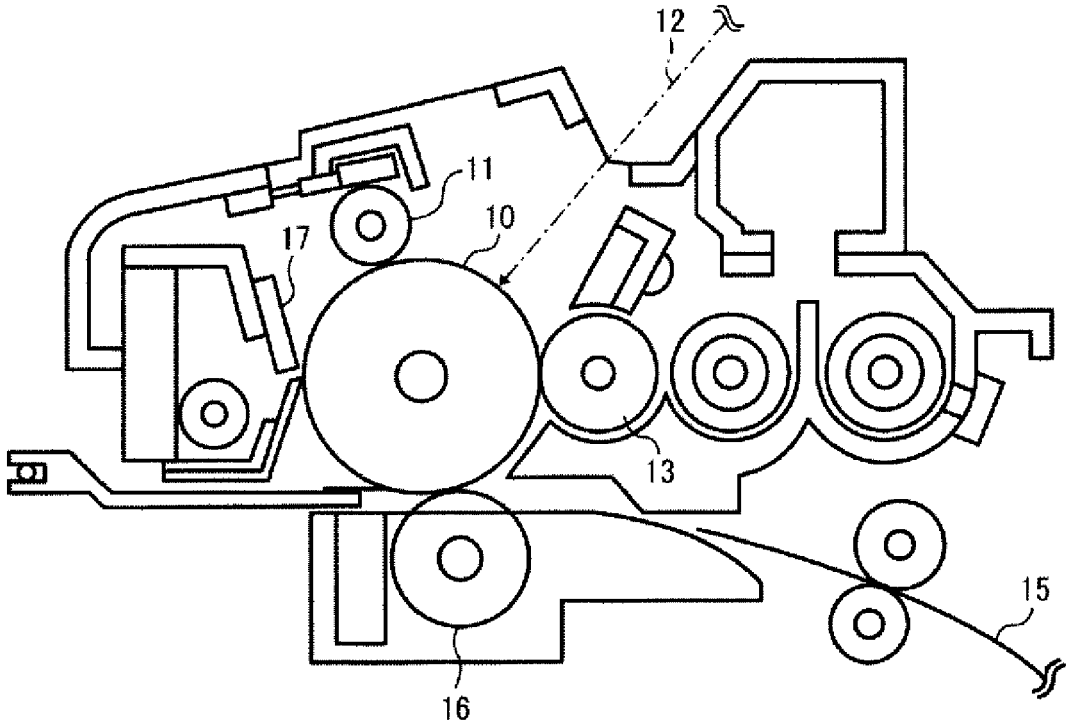
FIG. 7 is a schematic view illustrating another embodiment of the electrophotographic process and image forming apparatus of the present invention.

The process cartridge means an image forming unit (or device) including at least a photoreceptor 1, and one of a charger 11, an imagewise light irradiator 12, an image developer 13, an image transferer 16, a cleaner 17 and a discharger as shown in FIG. 7.

The above-mentioned tandem image forming apparatus produces full-color images at high speed because of capable of transferring plural toner images at a time.

However, the apparatus is inevitably enlarged because of needing at least four photoreceptors, and depending on an amount of toner consumed, the photoreceptors are differently abraded, resulting in deterioration of color reproducibility and production of abnormal images.

The photoreceptor having high sensitivity and stability of the present invention can have smaller diameter, and can produce full-color images having good color reproducibility even when used for long periods because increase of residual potential and sensitivity deterioration are reduced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Synthesis of Azo Pigment Having a Carbo-Ester Group

—Synthesis of Azo Pigment Having Formula III-3 ($E=C_5H_9O_2$)—

Similarly to Example 1 in Japanese published unexamined application No. 2009-7523, 0.83 g of a precursor of the compound III-3 (E=H) and 2.6 g (12 times mol) of pyrocarboxylic acid di-tert-butyl ester were dispersed in 150 ml of dehydrated pyridine, and after the dispersion was stirred at room temperature for 15 min, the dispersion was heated to have a temperature about 50° C. and reacted for 30 min. The dispersion gradually became reddish and a uniform solution was prepared. The solution was cooled to have a room temperature and the solvent was removed. Then, about 50 ml of ethylacetate were added thereto to prepare 1.18 g of a red powder (yield rate: 95.3%). The red powder was further purified by column chromatogram (silica gel/chloroform) to prepare the azo pigment having the formula III-3.

The result of elemental analysis of the azo pigment is shown in Table 1. All the carbo-ester groups are $C_5H_9O_2$ and the azo pigment has a formula of $C_{67}H_{60}N_6O_{13}Cl_2$.

TABLE 1

| Elemental Analysis | C | H | N |
|---|---|---|---|
| Found. (%) | 65.53 | 4.98 | 7.04 |
| Calcd. (%) | 65.52 | 4.92 | 6.84 |

An absorption by saturated hydrocarbon was observed at 2,980 $cm^{-1}$ and an absorption based on a stretching vibration of carbonate C═O was observed at 1,760 $cm^{-1}$ an infrared absorption spectrum (KBr tablet method) of the powder.

—Synthesis of Azo Pigment Having Formula III-4 ($E=C_6H_9O_2$)—

0.79 g of a precursor of the compound III-4 (E=H) and 2.6 g (12 times mol) of pyrocarboxylic acid di-tert-butyl ester were dispersed in 150 ml of dehydrated pyridine, and after the dispersion was stirred at room temperature for 15 min, the dispersion was heated to have a temperature about 50° C. and reacted for 30 min. The dispersion gradually became reddish and a uniform solution was prepared. The solution was cooled to have a room temperature and the solvent was removed. Then, about 50 ml of ethylacetate were added thereto to prepare 1.02 g of a red powder (yield rate: 85.6%). The red powder was further purified by column chromatogram (silica gel/chloroform) to prepare the azo pigment having the formula III-4.

The result of elemental analysis of the azo pigment is shown in Table 2. All the carbo-ester groups are $C_5H_9O_2$ and the azo pigment has a formula of $C_{69}H_{66}N_6O_{13}$.

TABLE 2

| Elemental Analysis | C | H | N |
|---|---|---|---|
| Found. (%) | 69.69 | 5.55 | 7.05 |
| Calcd. (%) | 69.80 | 5.60 | 7.08 |

An absorption by saturated hydrocarbon was observed at 2,980 $cm^{-1}$ and an absorption based on a stretching vibration of carbonate C═O was observed at 1,760 $cm^{-1}$ in an infrared absorption spectrum (KBr tablet method) of the powder.

—Synthesis of Azo Pigment Having Formula III-2 (E=$C_5H_9O_2$)—

1.61 g of a precursor of the compound III-2 (E=H) and 4.3 g (12 times mol) of pyrocarboxylic acid di-tert-butyl ester were dispersed in 50 ml of dehydrated pyridine and 200 ml of dehydrated N,N-dimethylformamide, and after the dispersion was stirred at room temperature for 15 min, the dispersion was heated to have a temperature about 50° C. and reacted for 2 hrs. The dispersion gradually became reddish and a uniform solution was prepared. The solution was cooled to have a room temperature and about 100 ml of ethylacetate were added thereto to prepare 2.24 g of a red powder (yield rate: 93%). The red powder was further purified by column chromatogram (silica gel/chloroform) to prepare the azo pigment having the formula III-2.

The result of elemental analysis of the azo pigment is shown in Table 3. All the carbo-ester groups are $C_5H_9O_2$ and the azo pigment has a formula of $C_{68}H_{63}N_6O_{13}Cl$.

TABLE 3

| Elemental Analysis | C | H | N |
|---|---|---|---|
| Found. (%) | 67.18 | 5.09 | 6.84 |
| Calcd. (%) | 67.63 | 5.26 | 6.96 |

An absorption by saturated hydrocarbon was observed at 2,980 $cm^{-1}$ and an absorption based on a stretching vibration of carbonate C═O was observed at 1,765 $cm^{-1}$ in an infrared absorption spectrum (KBr tablet method) of the powder.

—Synthesis of Azo Pigment Having Formula V-1 (E=$C_5H_9O_2$)—

0.92 g of a precursor of the compound V-1 (E=H) and 2.6 g (12 times mol) of pyrocarboxylic acid di-tert-butyl ester were dispersed in 150 ml of dehydrated pyridine, and after the dispersion was stirred at room temperature for 15 min, the dispersion was heated to have a temperature about 50° C. and reacted for 40 min. The dispersion gradually became reddish orange and a uniform solution was prepared. The solution was cooled to have a room temperature and the solvent was removed. Then, about 50 ml of ethylacetate were added thereto to prepare 1.16 g of a red powder (yield rate: 88.0%). The red powder was further purified by column chromatogram (silica gel/chloroform) to prepare the azo pigment having the formula The red powder was further purified by column chromatogram (silica gel/chloroform) to prepare the azo pigment having the formula V-1.

The result of elemental analysis of the azo pigment is shown in Table 4. All the carbo-ester groups are $C_5H_9O_2$ and the azo pigment has a formula of $C_{80}H_{80}N_6O_{12}$.

TABLE 4

| Elemental Analysis | C | H | N |
|---|---|---|---|
| Found. (%) | 72.69 | 6.03 | 6.45 |
| Calcd. (%) | 72.93 | 6.12 | 6.38 |

An absorption by saturated hydrocarbon was observed at 2,975 $cm^{-1}$ and an absorption based on a stretching vibration of carbonate C═O was observed at 1,760 $cm^{-1}$ in an infrared absorption spectrum (KBr tablet method) of the powder.

—Synthesis of Azo Pigment Having Formula VII-2 (E=$C_8H_7O_2$)—

1.20 g of a precursor of the compound VII-2 (E=H) and 1.6 g (12 times mol) of pyrocarboxylic acid di-benzyl ester were dispersed in 150 ml of dehydrated pyridine, and after the dispersion was stirred at room temperature for 15 min, the dispersion was heated to have a temperature about 50° C. and reacted for 1 hr. The dispersion gradually became reddish violet and a uniform solution was prepared. The solution was cooled to have a room temperature and the solvent was removed. Then, about 50 ml of cyclohexane were added thereto to prepare 1.60 g of a red powder (yield rate: 79.6%).

The result of elemental analysis of the azo pigment is shown in Table 5. All the carbo-ester groups are $C_8H_7O_2$ and the azo pigment has a formula of $C_{127}H_{75}N_{11}O_{20}$.

TABLE 5

| Elemental Analysis | C | H | N |
|---|---|---|---|
| Found. (%) | 73.98 | 3.30 | 7.45 |
| Calcd. (%) | 73.51 | 3.64 | 7.43 |

An absorption based on a stretching vibration of carbonate C═O was observed at 1,760 $cm^{-1}$ in an infrared absorption spectrum (KBr tablet method) of the powder.

—Synthesis of Azo Pigment Having Formula X-1 (E=$C_5H_9O_2$)—

0.16 g of a precursor of the compound X-1 (E=H) and 0.52 g (12 times mol) of pyrocarboxylic acid di-tert-butyl ester were dispersed in 30 ml of dehydrated pyridine, and after the dispersion was stirred at room temperature for 15 min, the dispersion was heated to have a temperature about 50° C. and reacted for 2 hrs. The dispersion gradually became reddish and a uniform solution was prepared. The solution was cooled to have a room temperature and the solvent was removed. Then, about 50 ml of ethylacetate were added thereto to prepare 0.16 g of a red powder (yield rate: 80%). The result of elemental analysis of the azo pigment is shown in Table 6. All the carbo-ester groups are $C_5H_9O_2$ and the azo pigment has a formula of $C_{64}H_{53}N_9O_{11}$.

TABLE 6

| Elemental Analysis | C | H | N |
|---|---|---|---|
| Found. (%) | 67.85 | 4.67 | 11.11 |
| Calcd. (%) | 68.38 | 4.75 | 11.21 |

An absorption by saturated hydrocarbon was observed at 2,980 $cm^{-1}$ and an absorption based on a stretching vibration of carbonate C═O was observed at 1,760 $cm^{-1}$ in an infrared absorption spectrum (KBr tablet method) of the powder.

(Synthesis of Complex Azo Pigment)

<Complex Azo Pigment 1>

[Preparation of Complex Azo Pigment Formed of Azo Pigment Having Formula III-3 ($E=C_5H_9O_2$) and Quinacridone Pigment]

0.98 g of the azo pigment having the formula III-3 ($E=C_5H_9O_2$) were heated while stirred in 100 ml of toluene to prepare a dark red-brown solution. After 0.25 g of a quinacridone pigment were added into the solution, 1.83 g of trifluoroacetic acid were further added therein and the solution was subjected to a reaction at 80° C. for 4.5 hrs while strongly stirred. After the azo pigment having the formula III-3 was observed by a thin-layer chromatography to have disappeared, the solution was filtered through a fluoro pore having a diameter of 0.1 μm at room temperature to prepare a filtered product, and which was washed twice in 100 ml of methanol to prepare 1.05 g of a dark mazarine powder.

The absorption by saturated hydrocarbon observed at 2,960 $cm^{-1}$ and the absorption based on a stretching vibration of carbonate C═O observed at 1,760 $cm^{-1}$ in an infrared absorption spectrum (KBr tablet method) of the azo pigment (III-3) disappeared.

<Complex Azo Pigment 2>

[Preparation of Complex Azo Pigment Formed of Azo Pigment Having Formula III-3 ($E=C_5H_9O_2$) and Azo Pigment Having Formula III-4 ($E=C_5H_9O_2$)]

0.98 g of the azo pigment having the formula III-3 ($E=C_5H_9O_2$) and 0.95 g of the azo pigment having the formula III-4 ($E=C_5H_9O_2$) were heated while stirred in 200 ml of toluene to prepare a dark red-brown solution. 1.8 g of trifluoroacetic acid were added therein and the solution was subjected to a reaction under reflux at for 5 hrs while strongly stirred. After the azo pigment having the formula III-3 and the azo pigment having the formula III-4 were observed by a thin-layer chromatography to have disappeared, the solution was filtered through a fluoro pore having a diameter of 0.1 μm at room temperature to prepare a filtered product, and which was washed twice in 200 ml of methanol to prepare 1.2 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of each of the azo pigment (III-3) and the azo pigment (III-4) disappeared.

<Complex Azo Pigment 3>

[Preparation of Complex Azo Pigment Formed of Azo Pigment Having Formula III-2 ($E=C_5H_9O_2$) and Azo Pigment Having Formula V-1 ($E=C_5H_9O_2$)]

0.97 g of the azo pigment having the formula III-2 ($E=C_5H_9O_2$) and 1.05 g of the azo pigment having the formula V-1 ($E=C_5H_9O_2$) were heated while stirred in 150 ml of chlorobenzene to prepare a dark red-brown solution. 0.9 g of trifluoroacetic acid were added therein and the solution was subjected to a reaction under reflux at for 3 hrs while strongly stirred. After the azo pigment having the formula III-2 and the azo pigment having the formula V-1 were observed by a thin-layer chromatography to have disappeared, the solution was filtered through a fluoro pore having a diameter of 0.1 μm at room temperature to prepare a filtered product, and which was washed twice in 200 ml of methanol to prepare 1.27 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of each of the azo pigment (III-2) and the azo pigment (V-1) disappeared.

<Complex Azo Pigment 4>

[Preparation of Complex Azo Pigment Formed of Azo Pigment Having Formula VII-2 ($E=C_8H_7O_2$) and Titanium Dioxide Pigment]

0.98 g of the azo pigment having the formula VII-2 ($E=C_8H_7O_2$) were heated while stirred in 100 ml of chlorobenzene to prepare a dark red-brown solution. After 0.3 g of a titanium dioxide pigment were added into the solution, 0.5 g of trifluoroacetic acid were further added therein and the solution was subjected to a reaction at 110° C. for 6 hrs while strongly stirred. After the azo pigment having the formula III-3 was observed by a thin-layer chromatography to have disappeared, the solution was filtered through a fluoro pore having a diameter of 0.1 μm at room temperature to prepare a filtered product, and which was washed twice in 100 ml of methanol to prepare 0.75 g of a dark mazarine powder.

The absorption based on a stretching vibration of carbonate C═O observed at 1,760 $cm^{-1}$ in an infrared absorption spectrum (KBr tablet method) of the azo pigment (VII-2) disappeared.

<Complex Azo Pigment 5>

[Preparation of Complex Azo Pigment Formed of Azo Pigment Having Formula X-1 ($E=C_5H_9O_2$) and Fullerene ($C_{60}$) Pigment]

0.15 g of the azo pigment having the formula X-1 ($E=C_6H_9O_2$) were heated while stirred in 50 ml of cyclohexanone to prepare a dark red-brown solution. After 0.29 g of a fullerene ($C_{60}$) pigment were added into the solution, 9.1 g of trifluoroacetic acid were further added therein and the solution was subjected to a reaction at 130° C. for 10 hrs while strongly stirred. After the azo pigment having the formula X-1 was observed by a thin-layer chromatography to have disappeared, the solution was filtered through a fluoro pore having a diameter of 0.1 μm at room temperature to prepare a filtered product, and which was washed twice in 50 ml of acetone to prepare 0.3 g of a dark mazarine powder.

The absorption by saturated hydrocarbon observed at 2,980 $cm^{-1}$ and the absorption based on a stretching vibration of carbonate CO observed at 1,760 $cm^{-1}$ in an infrared absorption spectrum (KBr tablet method) of the azo pigment (X-1) disappeared.

Example 1

An undercoat layer coating liquid, a CGL coating liquid and CTL coating liquid having the following formulations were coated and dried in this order on an aluminum cylinder having a diameter of 30 mm and a length of 340 mm as an electroconductive substrate to prepare a multilayer photoreceptor having an undercoat layer about 3.5 μm thick, a CGL, and a CTL about 28 μm thick. The CGL had a thickness so as to have a light transmittance of 20% for light having a wavelength of 650 nm. The transmittance was measured by a marketed spectrophotometer UV-3100 from Shimadzu Corp. with light having a wavelength of 650 nm for an aluminium cylinder wounded with a polyethyleneterephthalate film and coated with the following CGL coating liquid, and a polyethyleneterephthalate film not coated with the CGL coating liquid. After each layer was coated and dried until it does not feel sticky with a finger, the undercoat layer, CGL and CTL were dried at 130° C. for 20 min, 150° C. for 20 min and 120° C. for 20 min, respectively to prepare an electrophotographic photoreceptor 1.

(Undercoat Layer Coating Liquid)

| | |
|---|---|
| Titanium oxide<br>(CR-EL from Ishihara Sangyo Kaisha, ltd.) | 50 |
| Alkyd resin<br>(Bekkolite M6401-50 including a solid content of 50% by weight from Dainippon Ink And Chemicals, inc.) | 14 |
| Melamine resin<br>(Super Bekkamin L-145-60 including a solid content 60% by weight from Dainippon Ink And Chemicals, inc.) | 8 |
| 2-butanone | 120 |

(CGL Coating Liquid)

| | |
|---|---|
| Complex azo pigment 1 | 10 |
| Polyvinylbutyral BX-1<br>(from Sekisui Chemical Co., Ltd.) | 10 |
| Cyclohexanone | 420 |
| MEK | 180 |

(CTL Coating Liquid)

| | |
|---|---|
| Bisphenol Z polycarbonate<br>(Panlite TS-2050 from TEIJIN CHEMICALS LTD.) | 10 |
| CTM having the following formula: | 7 |

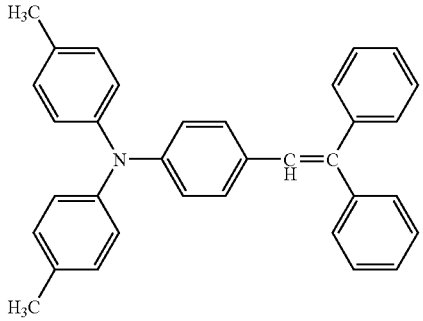

| | |
|---|---|
| Tetrahydrofuran | 80 |
| 1% silicone oil solution in tetrahydrofuran<br>(KF50-100CS from Shin-Etsu Chemical Industry Co., Ltd.) | 0.2 |

Example 2

The procedure for preparation of the electrophotographic photoreceptor 1 in Example 1 was repeated except for replacing the complex azo pigment 1 in the CGL coating liquid with the complex azo pigment 2 to prepare an electrophotographic photoreceptor 2.

Example 3

The procedure for preparation of the electrophotographic photoreceptor 1 in Example 1 in the CGL coating liquid was repeated except for replacing the complex azo pigment 1 with the complex azo pigment 3 to prepare an electrophotographic photoreceptor 3.

Example 4

The procedure for preparation of the electrophotographic photoreceptor 1 in Example 1 in the CGL coating liquid was repeated except for replacing the complex azo pigment 1 with the complex azo pigment 4 to prepare an electrophotographic photoreceptor 4.

Example 5

The procedure for preparation of the electrophotographic photoreceptor 1 in Example 1 in the CGL coating liquid was repeated except for replacing the complex azo pigment 1 with the complex azo pigment 5 to prepare an electrophotographic photoreceptor 5.

Comparative Example 1

The procedure for preparation of the electrophotographic photoreceptor 1 in Example 1 was repeated except for replacing the CGL coating liquid with the following one to prepare an electrophotographic photoreceptor 6.

(CGL Coating Liquid)

| | |
|---|---|
| Quinacridone pigment | 2 |
| Azo pigment (III-3)<br>(E = H, not de-carbo esterified) | 8 |
| Polyvinylbutyral BX-1<br>(from Sekisui Chemical Co., Ltd.) | 10 |
| Cyclohexanone | 420 |
| MEK | 180 |

Comparative Example 2

The procedure for preparation of the electrophotographic photoreceptor 1 in Example 1 was repeated except for replacing the CGL coating liquid with the following one to prepare an electrophotographic photoreceptor 7.

(CGL Coating Liquid)

| | |
|---|---|
| Azo pigment (III-4)<br>(E = H, not de-carbo esterified) | 5 |
| Azo pigment (III-2)<br>(E = H, not de-carbo esterified) | 5 |
| Polyvinylbutyral BX-1<br>(from Sekisui Chemical Co., Ltd.) | 10 |
| Cyclohexanone | 420 |
| MEK | 180 |

Comparative Example 3

The procedure for preparation of the electrophotographic photoreceptor 1 in Example 1 was repeated except for replacing the CGL coating liquid with the following one to prepare an electrophotographic photoreceptor 8.

(CGL Coating Liquid)

| | |
|---|---|
| Azo pigment (III-2)<br>(E = H, not de-carbo esterified) | 5 |
| Azo pigment (V-1)<br>(E = H, not de-carbo esterified) | 5 |
| Polyvinylbutyral BX-1<br>(from Sekisui Chemical Co., Ltd.) | 10 |
| Cyclohexanone | 420 |
| MEK | 180 |

Comparative Example 4

The procedure for preparation of the electrophotographic photoreceptor 1 in Example 1 was repeated except for replacing the CGL coating liquid with the following one to prepare an electrophotographic photoreceptor 9.

(CGL Coating Liquid)

| | |
|---|---|
| Azo pigment (VII-2) (E = H, not de-carbo esterified) | 8 |
| Titanium dioxide pigment | 2 |
| Polyvinylbutyral BX-1 (from Sekisui Chemical Co., Ltd.) | 10 |
| Cyclohexanone | 420 |
| MEK | 180 |

Comparative Example 5

The procedure for preparation of the electrophotographic photoreceptor 1 in Example 1 was repeated except for replacing the CGL coating liquid with the following one to prepare an electrophotographic photoreceptor 10.

(CGL Coating Liquid)

| | |
|---|---|
| Azo pigment (X-1) (E = H, not de-carbo esterified) | 3 |
| Fullerene ($C_{60}$) | 7 |
| Polyvinylbutyral BX-1 (from Sekisui Chemical Co., Ltd.) | 10 |
| Cyclohexanone | 420 |
| MEK | 180 |

Comparative Example 6

The procedure for preparation of the electrophotographic photoreceptor 1 in Example 1 was repeated except for replacing the CGL coating liquid with the following one to prepare an electrophotographic photoreceptor 11.

(CGL Coating Liquid)

| | |
|---|---|
| Azo pigment (III-3) (E = H, not de-carbo esterified) | 10 |
| Polyvinylbutyral BX-1 (from Sekisui Chemical Co., Ltd.) | 10 |
| Cyclohexanone | 420 |
| MEK | 180 |

Comparative Example 7

The procedure for preparation of the electrophotographic photoreceptor 1 in Example 1 was repeated except for replacing the CGL coating liquid with the following one to prepare an electrophotographic photoreceptor 12.

(CGL Coating Liquid)

| | |
|---|---|
| Azo pigment (III-4) (E = H, not de-carbo esterified) | 10 |
| Polyvinylbutyral BX-1 (from Sekisui Chemical Co., Ltd.) | 10 |

-continued

| | |
|---|---|
| Cyclohexanone | 420 |
| MEK | 180 |

Comparative Example 8

The procedure for preparation of the electrophotographic photoreceptor 1 in Example 1 was repeated except for replacing the CGL coating liquid with the following one to prepare an electrophotographic photoreceptor 13.

(CGL Coating Liquid)

| | |
|---|---|
| Azo pigment (III-2) (E = H, not de-carbo esterified) | 10 |
| Polyvinylbutyral BX-1 (from Sekisui Chemical Co., Ltd.) | 10 |
| Cyclohexanone | 420 |
| MEK | 180 |

Comparative Example 9

The procedure for preparation of the electrophotographic photoreceptor 1 in Example 1 was repeated except for replacing the CGL coating liquid with the following one to prepare an electrophotographic photoreceptor 14.

(CGL Coating Liquid)

| | |
|---|---|
| Azo pigment (V-1) (E = H, not de-carbo esterified) | 10 |
| Polyvinylbutyral BX-1 (from Sekisui Chemical Co., Ltd.) | 10 |
| Cyclohexanone | 420 |
| MEK | 180 |

Comparative Example 10

The procedure for preparation of the electrophotographic photoreceptor 1 in Example 1 was repeated except for replacing the CGL coating liquid with the following one to prepare an electrophotographic photoreceptor 15.

(CGL Coating Liquid)

| | |
|---|---|
| Azo pigment (VII-2) (E = H, not de-carbo esterified) | 10 |
| Polyvinylbutyral BX-1 (from Sekisui Chemical Co., Ltd.) | 10 |
| Cyclohexanone | 420 |
| MEK | 180 |

Comparative Example 11

The procedure for preparation of the electrophotographic photoreceptor 1 in Example 1 was repeated except for replacing the CGL coating liquid with the following one to prepare an electrophotographic photoreceptor 16.

(CGL Coating Liquid)

| | |
|---|---|
| Azo pigment (X-1) (E = H, not de-carbo esterified) | 10 |
| Polyvinylbutyral BX-1 (from Sekisui Chemical Co., Ltd.) | 10 |
| Cyclohexanone | 420 |
| MEK | 180 |

Each of the electrophotographic photoreceptor was installed in a process cartridge for electrophotography, and the process cartridge was set in imagio Neo 271 from Ricoh Company, Ltd. to produce a solid image. The irradiated part potential of the photoreceptor, and image density and abnormal images such as black spot, white spot, black stripe and white stripe of the solid image were comprehensively evaluated.

The evaluation was made initially and after 300,000 images (A4 My Paper from NES Ricoh Co., Ltd.) were produced, and the photoreceptor had a potential of −800 V at the start.

The bright space potential of the photoreceptor was measured as follows.

The developing unit was disassembled and a probe connected to a surface electrometer TREK MODEL 344 was fitted on the developing unit sp as to be located at a position 50 mm from the top of the photoreceptor. The photoreceptor was set in the unit and a solid image was produced after a grid potential was controlled so that the photoreceptor had a dark space potential of −800V, and a bright space potential was measured. The evaluation was made based on the following levels under in environment of room temperature.

Good: almost no image quality deterioration

Poor: Image quality deterioration is observable

Very poor: Seriously poor image quality

The results are shown in Table 7.

TABLE 7

| | | Initial | | After 300,000 | |
|---|---|---|---|---|---|
| | | Potential (−v) | Image quality | Potential (−v) | Image quality |
| Example 1 | Photoreceptor 1 | 100 | Good | 120 | Good |
| Example 2 | Photoreceptor 2 | 90 | Good | 100 | Good |
| Example 3 | Photoreceptor 3 | 105 | Good | 110 | Good |
| Example 4 | Photoreceptor 4 | 110 | Good | 110 | Good |
| Example 5 | Photoreceptor 5 | 105 | Good | 110 | Good |
| Comparative Example 1 | Photoreceptor 6 | 130 | Good | 180 | Poor |
| Comparative Example 2 | Photoreceptor 7 | 120 | Good | 150 | Poor |
| Comparative Example 3 | Photoreceptor 8 | 130 | Good | 160 | Poor |
| Comparative Example 4 | Photoreceptor 9 | 120 | Good | 160 | Poor |
| Comparative Example 5 | Photoreceptor 10 | 120 | Good | 155 | Poor |
| Comparative Example 6 | Photoreceptor 11 | 125 | Good | 160 | Poor |
| Comparative Example 7 | Photoreceptor 12 | 120 | Good | 150 | Poor |
| Comparative Example 8 | Photoreceptor 13 | 130 | Good | 165 | Poor |
| Comparative Example 9 | Photoreceptor 14 | 150 | Poor | 190 | Very poor |
| Comparative Example 10 | Photoreceptor 15 | 160 | Poor | 205 | Very poor |
| Comparative Example 11 | Photoreceptor 16 | 150 | Poor | 195 | Very poor |

<Synthesis of Titanylphthalocyanine Pigment for Use in the Present Invention>

Synthesis Example

A pigment was prepared by the method disclosed in Example 1 of Japanese published unexamined application No. 2004-83859. Specifically, 292 parts of 1,3-diiminoisoindoline and 1,800 parts of sulfolane were mixed to prepare a mixture, and 204 parts of titanium tetrabutoxide was dropped into the mixture under a nitrogen gas flow. The mixture was then gradually heated to have a temperature of 180° C. and a reaction was performed for 5 hours at a temperature of from 170 to 180° C. while agitating. After the reaction, the reaction product was cooled, followed by filtering. The thus prepared wet cake was washed with chloroform until the cake colored blue. Then the cake was washed several times with methanol, followed by washing several times with hot water heated to 80° C. and drying to prepare a crude titanylphthalocyanine.

60 parts of the crude titanylphthalocyanine pigment was stirred mixed and dissolved in 1,000 parts of sulfonic acid having a concentration of 96%, and filtered to prepare a sulfonic acid solution. The sulfonic acid solution was dropped in 35,000 parts of iced water while stirred and a precipitated crystal was filtered. Then, the crystal was repeatedly washed with water until the water became neutral to prepare an aqueous paste of a titanylphthalocyanine pigment. 1,500 parts of tetrahydrofuran were added to the aqueous paste and the mixture was strongly agitated with a HOMOMIXER (MARK IIf from Kenis Ltd.) at a revolution of 2,000 rpm until the color of the paste was changed from navy blue to light blue. The color was changed after the agitation was performed for about 20 minutes. The dispersion was then filtered under a reduced pressure. The thus obtained crystal on the filter was washed with tetrahydrofuran to prepare 98 parts of a wet cake of the pigment. The wet cake was dried for 2 days at 70° C. under a reduced pressure of 5 mmHg to prepare 78 parts of a titanylphthalocyanine pigment having the following formula (10):

(10)

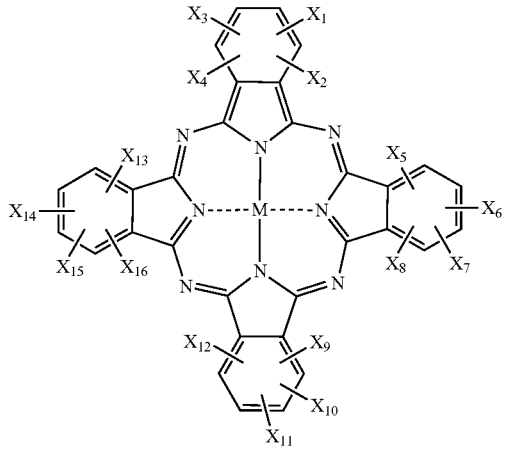

wherein M is TiO; and $X_1$ to $X_{16}$ independently represent a hydrogen atom, a halogen atom, a hydroxyl group, a nitro group, a cyano group, an ester group, an alkyl group, an alkenyl group, an alkoxyl group, an aryl group and an aryloxyl group.

X-ray diffraction spectrum of the titanylphthalocyanine powder was measured by the following conditions to find that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3°. The result is shown in FIG. 8.

<X-Ray Diffraction Spectrum Measurement Conditions>

X-ray tube: Cu
Voltage: 50 kV
Current: 30 mA
Scanning speed: 2°/min
Scanning range: 3 to 40°
Time constant: 2 sec <Complex Azo Pigment 6>

A mixed liquid including the azo pigment having the formula III-3 and the titanylphthalocyanine pigment was prepared as mentioned below, and which was chemically and thermally de-carbo esterified to prepare a complex azo pigment 6.

[Preparation of Complex Azo Pigment Formed of Azo Pigment Having Formula III-3 ($E=C_5H_9O_2$) and Titanylphthalocyanine Pigment]

0.98 g of the azo pigment having the formula III-3 ($E=C_5H_9O_2$) were heated while stirred in 100 ml of toluene to prepare a dark red-brown solution. After 0.46 g of a titanylphthalocyanine pigment were added into the solution, 0.9 g of trifluoroacetic acid and 0.5 g of water were further added therein and the solution was subjected to a reaction at 80° C. for 9 hrs while strongly stirred. After the azo pigment having the formula III-3 was observed by a thin-layer chromatography to have disappeared, the solution was filtered through a fluoro pore having a diameter of 0.1 μm at room temperature to prepare a filtered product, and which was washed twice in 100 ml of methanol to prepare 1.05 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of the azo pigment (III-3) disappeared.

<Complex Azo Pigment 7>

A mixed liquid including the azo pigment having the formula III-2 and the titanylphthalocyanine pigment was prepared as mentioned below, and which was chemically and thermally de-carbo esterified to prepare a complex azo pigment 7.

[Preparation of Complex Azo Pigment Formed of Azo Pigment Having Formula III-2 ($E=C_5H_9O_2$) and Titanylphthalocyanine Pigment]

0.97 g of the azo pigment having the formula II-2 ($E=C_5H_9O_2$) were heated while stirred in 100 ml of toluene to prepare a dark red-brown solution. After 0.46 g of a titanylphthalocyanine pigment were added into the solution, 1.8 g of trifluoroacetic acid and 1.0 g of water were further added therein and the solution was subjected to a reaction at 80° C. for 9 hrs while strongly stirred. After the azo pigment having the formula III-2 was observed by a thin-layer chromatography to have disappeared, the solution was filtered through a fluoro pore having a diameter of 0.1 μm at room temperature to prepare a filtered product, and which was washed twice in 100 ml of methanol to prepare 1.04 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of the azo pigment (III-2) disappeared.

<Complex Azo Pigment 8>

A mixed liquid including an azo pigment having the formula VII-5, synthesized as below and the titanylphthalocyanine pigment was prepared as mentioned below, and which was chemically and thermally de-carbo esterified to prepare a complex azo pigment 8.

[Synthesis of Azo Pigment Having a Carbo-Ester Group and the Formula VII-5]

0.81 g of a precursor of the compound VII-5 (E=H) and 2.7 g (12 times mol) of pyrocarboxylic acid di-tert-amyl ester were dispersed in 150 ml of dehydrated pyridine, and after the dispersion was stirred at room temperature for 15 min, the dispersion was heated to have a temperature about 50° C. and reacted for 2 hrs. The dispersion gradually became reddish and a uniform solution was prepared. The solution was cooled to have a room temperature and the solvent was removed. Then, about 50 ml of ethylacetate were added thereto to prepare 1.1 g of a red powder (yield rate: 86.6%).

The result of elemental analysis of the azo pigment is shown in Table 8. All the carbo-ester groups are $C_6H_{11}O_2$ and the azo pigment has a formula of $C_{75}H_{72}N_6O_{13}$.

TABLE 8

| Elemental Analysis | C | H | N |
|---|---|---|---|
| Found. (%) | 71.20 | 5.79 | 6.35 |
| Calcd. (%) | 71.19 | 5.74 | 6.64 |

An absorption by saturated hydrocarbon was observed at 2,980 $cm^{-1}$ and an absorption based on a stretching vibration of carbonate C═O was observed at 1,760 $cm^{-1}$ in an infrared absorption spectrum (KBr tablet method) of the powder.

[Preparation of Complex Azo Pigment Formed of Azo Pigment Having Formula VII-5 ($E=C_6H_{11}O_2$) and Titanylphthalocyanine Pigment]

1.01 g of the azo pigment having the formula VII-5 ($E=C_6H_{11}O_2$) were heated while stirred in 100 ml of 2-butanone to prepare a dark red-brown solution. After 0.92 g of a titanylphthalocyanine pigment were added into the solution, 18.2 g of trifluoroacetic acid, 10 g of acetic acid and 0.5 g of water were further added therein and the solution was subjected to a reaction at 80° C. for 6 hrs while strongly stirred. After the azo pigment having the formula III-2 was observed by a thin-layer chromatography to have disappeared, the solution was filtered through a fluoro pore having a diameter of 0.1 μm at room temperature to prepare a filtered product, and which was washed twice in 100 ml of methanol to prepare 1.45 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of the azo pigment (III-2) disappeared.

<Complex Azo Pigment 9>

A mixed liquid including the azo pigment having the formula VI-1, synthesized as below and the titanylphthalocyanine pigment was prepared as mentioned below, and which was chemically and thermally de-carbo esterified to prepare a complex azo pigment 9.

[Synthesis of Azo Pigment Having a Carbo-Ester Group and the Formula VI-1]

0.94 g of a precursor of the compound VI-1 (E=H) and 2.6 g (12 times mol) of pyrocarboxylic acid di-tert-butyl ester were dispersed in 150 ml of dehydrated pyridine, and after the dispersion was stirred at room temperature for 15 min, the dispersion was heated to have a temperature about 50° C. and reacted for 2 hrs. The dispersion gradually became reddish and a uniform solution was prepared. The solution was cooled to have a room temperature and the solvent was removed. Then, about 50 ml of ethylacetate were added thereto to prepare 1.1 g of a red powder (yield rate: 83.2%).

The result of elemental analysis of the azo pigment is shown in Table 9. All the carbo-ester groups are $C_5H_9O_2$ and the azo pigment has a formula of $C_{68}H_{60}N_6O_{14}Br_2$.

TABLE 9

| Elemental Analysis | C | H | N |
|---|---|---|---|
| Found. (%) | 60.66 | 4.73 | 6.35 |
| Calcd. (%) | 60.72 | 4.50 | 6.25 |

An absorption by saturated hydrocarbon was observed at 2,980 $cm^{-1}$ and an absorption based on a stretching vibration of carbonate C═O was observed at 1,760 $cm^{-1}$ in an infrared absorption spectrum (KBr tablet method) of the powder.

[Preparation of Complex Azo Pigment Formed of Azo Pigment Having Formula VI-1 (E=$C_5H_9O_2$) and Titanylphthalocyanine Pigment]

0.34 g of the azo pigment having the formula VI-1 (E=$C_5H_9O_2$) were heated while stirred in 100 ml of N,N-dimethylformamide to prepare a dark red-brown solution. After 3.1 g of a titanylphthalocyanine pigment were added into the solution, 5.2 g of paratoluene sulfonic acid were further added therein and the solution was subjected to a reaction at 150° C. for 9 hrs while strongly stirred. After the azo pigment having the formula III-2 was observed by a thin-layer chromatography to have disappeared, the solution was filtered through a fluoro pore having a diameter of 0.1 μm at room temperature to prepare a filtered product, and which was washed twice in 100 ml of 2-butanone to prepare 3.2 g of a dark mazarine powder.

The absorption by saturated hydrocarbon observed at 2,980 $cm^{-1}$ and the absorption based on a stretching vibration of carbonate C═O observed at 1,760 $cm^{-1}$ in an infrared absorption spectrum (KBr tablet method) of the azo pigment (III-2) disappeared.

Example 6

An undercoat layer coating liquid, a CGL coating liquid and CTL coating liquid having the following formulations were coated and dried in this order on an aluminum cylinder having a diameter of 30 mm and a length of 340 mm as an electroconductive substrate to prepare a multilayer photoreceptor having an undercoat layer about 3.5 μm thick, a CGL, and a CTL about 28 μm thick. The CGL had a thickness so as to have a light transmittance of 20% for light having a wavelength of 780 nm. The transmittance was measured by a marketed spectrophotometer UV-3100 from Shimadzu Corp. with light having a wavelength of 780 nm for an aluminium cylinder wounded with a polyethyleneterephthalate film and coated with the following CGL coating liquid, and a polyethyleneterephthalate film not coated with the CGL coating liquid. After each layer was coated and dried until it does not feel sticky with a finger, the undercoat layer, CGL and CTL were dried at 130° C. for 20 min, 150° C. for 20 min and 120° C. for 20 min, respectively to prepare an electrophotographic photoreceptor 17.

(Undercoat Layer Coating Liquid)

| | |
|---|---|
| Titanium oxide (CR-EL from Ishihara Sangyo Kaisha, ltd.) | 50 |
| Alkyd resin (Bekkolite M6401-50 including a solid content of 50% by weight from Dainippon Ink And Chemicals, inc.) | 14 |
| Melamine resin (Super Bekkamin L-145-60 including a solid content 60% by weight from Dainippon Ink And Chemicals, Inc.) | 8 |
| 2-butanone | 120 |

(CGL Coating Liquid)

| | |
|---|---|
| Complex azo pigment 1 | 10 |
| Polyvinylbutyral BX-1 (from Sekisui Chemical Co., Ltd.) | 10 |
| MEK | 600 |

(CTL Coating Liquid)

| | |
|---|---|
| Bisphenol Z polycarbonate (Panlite TS-2050 from TEIJIN CHEMICALS LTD.) | 10 |
| CTM having the following formula: | 7 |

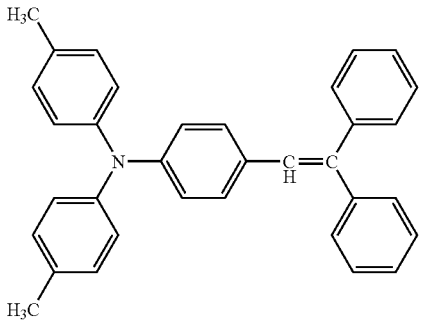

| | |
|---|---|
| Tetrahydrofuran | 80 |
| 1% silicone oil solution in tetrahydrofuran (KF50-100CS from Shin-Etsu Chemical Industry Co., Ltd.) | 0.2 |

Example 7

The procedure for preparation of the electrophotographic photoreceptor 17 in Example 6 was repeated except for replacing the complex are pigment 6 in the CGL coating liquid with the complex azo pigment 7 to prepare an electrophotographic photoreceptor 18.

Example 8

The procedure for preparation of the electrophotographic photoreceptor 17 in Example 6 was repeated except for replacing the CGL coating liquid with the following one to prepare an electrophotographic photoreceptor 19.

(CGL Coating Liquid)

| | |
|---|---|
| Complex azo pigment 6 | 10 |
| Polyvinylbutyral BX-1 (from Sekisui Chemical Co., Ltd.) | 2 |
| MEK | 360 |

Example 9

The procedure for preparation of the electrophotographic photoreceptor 17 in Example 6 was repeated except for replacing the complex azo pigment 6 in the CGL coating liquid with the complex azo pigment 8 to prepare an electrophotographic photoreceptor 20.

Example 10

The procedure for preparation of the electrophotographic photoreceptor 17 in Example 6 was repeated except for replacing the complex azo pigment 6 in the CGL coating liquid with the complex azo pigment 9 to prepare an electrophotographic photoreceptor 21.

Comparative Example 12

The procedure for preparation of the electrophotographic photoreceptor 17 in Example 6 was repeated except for replacing the complex azo pigment 6 in the CGL coating liquid with the titanylphthalocyanine pigment synthesized in Synthesis Example to prepare an electrophotographic photoreceptor 22.

Comparative Example 13

The procedure for preparation of the electrophotographic photoreceptor 19 in Example 8 was repeated except for replacing the complex azo pigment 6 in the CGL coating liquid with the titanylphthalocyanine pigment synthesized in Synthesis Example to prepare an electrophotographic photoreceptor 23.

Comparative Example 14

The procedure for preparation of the electrophotographic photoreceptor 17 in Example 6 was repeated except for replacing the CGL coating liquid with the following one to prepare an electrophotographic photoreceptor 24.

(CGL Coating Liquid)

| | |
|---|---|
| Titanylphthalocyanine pigment synthesized in Synthesis Example | 5 |
| Azo pigment (III-3) (E = H, not de-carbo esterified) | 5 |
| Polyvinylbutyral BX-1 (from Sekisui Chemical Co., Ltd.) | 10 |
| MEK | 600 |

Comparative Example 15

The procedure for preparation of the electrophotographic photoreceptor 17 in Example 6 was repeated except for replacing the CGL coating liquid with the following one to prepare an electrophotographic photoreceptor 25.

(CGL Coating Liquid)

| | |
|---|---|
| Titanylphthalocyanine pigment synthesized in Synthesis Example | 5 |
| Azo pigment (III-2) (E = H, not de-carbo esterified) | 5 |
| Polyvinylbutyral BX-1 (from Sekisui Chemical Co., Ltd.) | 10 |
| MEK | 600 |

Comparative Example 16

The procedure for preparation of the electrophotographic photoreceptor 17 in Example 6 was repeated except for replacing the CGL coating liquid with the following one to prepare an electrophotographic photoreceptor 26.

(CGL Coating Liquid)

| | |
|---|---|
| Titanylphthalocyanine pigment synthesized in Synthesis Example | 5 |
| Azo pigment (VII-5) (E = H, not de-carbo esterified) | 5 |
| Polyvinylbutyral BX-1 (from Sekisui Chemical Co., Ltd.) | 10 |
| MEK | 600 |

<Evaluation of Crystal Stability of CGL Coating Liquid>

The CGL coating liquids in Examples 6 to 10 and Comparative Examples 12 and 13 were stored for 30 days after prepared, and X-ray diffraction spectra thereof were measured by RINT-1100 from Rigaku Corp. under the following conditions:

X-ray tube: Cu

Voltage: 40 kV

Current: 20 mA

Scanning speed: 1°/min

Scanning range: 3 to 40°.

The measurement was made on the complex azo pigment or the titnaylphthalocyanine pigment before dispersed, after the CGL coating liquid was prepared and after stored for 30 days. The crystal form of the titanylphthalocyanine was evaluated from peak intensity at Bragg (2θ) angles of 26.2±0.2° and 27.2±0.2° of the X-ray diffraction spectrum. The results are shown in Table 10.

TABLE 10

| | X-ray Diffraction Peak intensity [cps] | | | | | |
|---|---|---|---|---|---|---|
| | Before dispersed | | After dispersed | | After 30 days | |
| | 26.2° | 27.2° | 26.2° | 27.2° | 26.2° | 27.2° |
| Example 6 | No peak | 3100 | No peak | 2100 | No peak | 2600 |
| Example 7 | No peak | 3500 | No peak | 2500 | No peak | 2300 |
| Example 8 | No peak | 3100 | No peak | 2000 | No peak | 2400 |
| Example 9 | No peak | 3200 | No peak | 2000 | No peak | 2700 |
| Example 10 | No peak | 3100 | No peak | 2100 | No peak | 2600 |
| Comparative Example 12 | No peak | 3100 | No peak | 3100 | No peak | 2900 |
| Comparative Example 13 | No peak | 3100 | 400 | 2300 | 800 | 2000 |

A difference of the peak intensities between Example 6 and 8 is smaller than a difference thereof between Comparative Examples 12 and 13, and therefore the complex azo pigment of the present invention is free from crystal transformation and stable.

Each of the electrophotographic photoreceptor was installed in a process cartridge for electrophotography, and the process cartridge was set in imagio Neo 271 from Ricoh Company, Ltd. The bright space potential (VL) of the photoreceptor was measured in an environment of high temperature and high humidity, and/or room temperature and room humidity initially and after 300,000 images (A4 My Paper from NBS Ricoh Co., Ltd.) were produced, and the photoreceptor had a potential of −800 V at the start.

The measuremnt was made as follows.

After the photoreceptor was stored in an environment of high temperature and high humidity (30° C. 90%), and/or room temperature and room humidity (23° C. 55%) for 24 hrs, the developing unit was disassembled and a probe connected to a surface electrometer TREK MODEL 344 was fitted on the developing unit sp as to be located at a position 50 mm from the top of the photoreceptor. The photoreceptor was set in the unit and a solid image was produced after a grid potential was controlled so that the photoreceptor had a dark space potential of −800V, and a bright space potential (VL) was measured.

Further, after 300,000 images were produced, the photoreceptor was uninstalled and exposed in an atmosphere of mixed gas of NO of 40 ppm and $NO_2$ of 10 ppm for 2 days, and installed again to produce an image to evaluate.

Good: almost no image quality deterioration

Poor: Image quality deterioration is observable

Very poor: Seriously poor image quality

The results are shown in Table 11.

TABLE 11

| | | Initial | | After 300,000 | | |
|---|---|---|---|---|---|---|
| | | High temperature high humidity VL (−V) | Room temperature Room humidity VL (−V) | Room temperature Room humidity VL (−V) | Image quality | Image quality after exposed in GAS |
| Example 6 | Photoreceptor 17 | 95 | 100 | 110 | Good | Good |
| Example 7 | Photoreceptor 18 | 100 | 110 | 115 | Good | Good |
| Example 8 | Photoreceptor 19 | 75 | 80 | 85 | Good | Good |
| Example 9 | Photoreceptor 20 | 110 | 115 | 130 | Good | Good |
| Example 10 | Photoreceptor 21 | 115 | 120 | 140 | Good | Good |
| Comparative Example 12 | Photoreceptor 22 | 130 | 150 | 200 | Good | Very poor |
| Comparative Example 13 | Photoreceptor 23 | 260 | 300 | 450 | Very poor | Very poor |
| Comparative Example 14 | Photoreceptor 24 | 100 | 130 | 160 | Poor | Very poor |
| Comparative Example 15 | Photoreceptor 25 | 95 | 135 | 170 | Poor | Very poor |
| Comparative Example 16 | Photoreceptor 26 | 140 | 175 | 220 | Poor | Very poor |
| Comparative Example 17 | Photoreceptor 27 | 150 | 190 | 230 | Poor | Very poor |

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-136158 and 2009-136166, both filed on Jun. 5, 2009, the entire contents of which are herein incorporated by reference.

What is claimed is:

1. An electrophotographic photoreceptor, comprising:

an electroconductive substrate; and a photosensitive layer, overlying the substrate, wherein the photosensitive layer comprises a complex azo pigment comprising:

a first azo compound having the following formula $$A(H)n \quad (a)$$

wherein A represents a residue of an azo compound, bonded with n pieces of hydrogen atom through one or more heteroatom being N or O and forming a part of the residue A; H represents a hydrogen atom; and n represents an integer of from 1 to 9, and a pigment selected from the group consisting of quinacridone, titanium oxide, fullerene, titanylphthalocyanine, and other azo pigments different from the azo compound having the formula (a), wherein the first azo compound is prepared by dissolving in an organic solvent and de-carbo esterifying a second azo compound having a carbo-ester group and the following formula (I):

$$A(E)n \quad (I)$$

wherein A represents a residue of an azo compound, bonded with n pieces of E group through one or more heteroatom being N or O and forming a part of the residue A; E independently represents a hydrogen atom or a carbo-ester group having a formula of —(═O)—O—R1, wherein R1 represents a substituted or an unsubstituted alkyl group having 4 to 10 carbon atoms, an alkenyl group, an alkynyl group, a cycloalkyl group, a cycloalkenyl group or an aralkyl group; and n represents an integer of from 1 to 9.

2. The electrophotographic photoreceptor of claim 1, wherein the pigment is dissolved with the second azo compound in the organic solvent.

3. The electrophotographic photoreceptor of claim 1, wherein the azo compounds having the formula (I) and (a) have the residue A having the following formula (II):

$$B—(N═N—Cp)m \quad (II)$$

wherein B represents a main backbone of an azo compound; Cp represents a coupler component residue; and m represents an integer of 2 or 3.

4. The electrophotographic photoreceptor of claim 3, wherein the Cp is at least one of compounds having the following formulae (1) to (9):

(1)

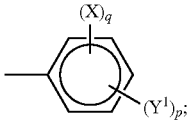

(2)

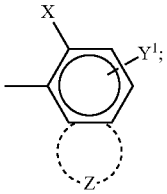

(3)

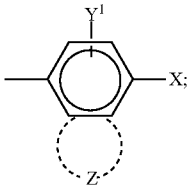

(4)

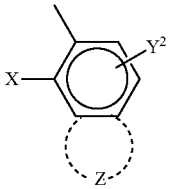

wherein X represents —OH, —N($R^1$)($R^2$) or —NHSO$_2$—$R^3$ wherein $R^1$ and $R^2$ independently represents a hydrogen atom or a substituted or an unsubstituted alkyl group, and $R^3$ represents a substituted or an unsubstituted alkyl group or a substituted or an unsubstituted aryl group; $Y^1$ represents a hydrogen atom, a halogen atom, a substituted or an unsubstituted alkyl group, a substituted or an unsubstituted alkoxy group, a carboxy group, a sulfone group, a substituted or an unsubstituted sulfamoyl group or —CON($R^4$)($Y^2$) wherein $R^4$ represents an alkyl group or its substituents, or a phenyl group or its substituents, and $Y^2$ represents a ring hydrocarbon group or its substituents, a heterocyclic group or its substituents, or —N═C($R^5$)($R^6$) wherein $R^5$ represents a ring hydrocarbon group or its substituents, a heterocyclic group or its substituents, or a styryl -group or s substituents, $R^5$ represents a hydrogen atom, an alkyl group, or a phenyl group or its substituents, and alternatively $R^5$ and $R^6$ optionally form a ring with carbon atoms bonded therewith; Z represents a ring hydrocarbon group or its substituents, or a heterocyclic group or its substituents; P represents an integer of 1 or 2; and q represents an integer of 1 or 2;

(5)

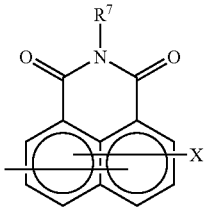

wherein $R^7$ represents a substituted or an unsubstituted hydrocarbon group; and X is same as the above-mentioned;

(6)

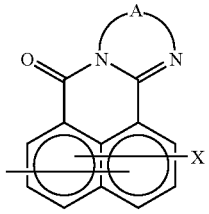

wherein A represents an of aromatic hydrocarbon bivalent group or a heterocyclic bivalent group including a nitrogen atom in the ring optionally substituted or unsubstituted; and X is same as the above-mentioned;

(7)

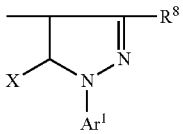

wherein $R^8$ represents an alkyl group, a carbamoyl group, a carboxy group or its esters; $Ar_1$ represents a ring hydrocarbon group or its substituents; and X is same as the above-mentioned;

(8)

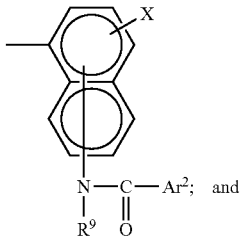

(9)

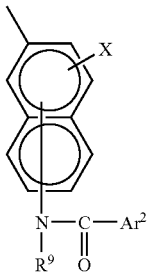

wherein $R^9$ represents a hydrogen atom, or a substituted or an unsubstituted hydrocarbon group; and $Ar^2$ a ring hydrocarbon group or its substituents.

5. The electrophotographic photoreceptor of claim 3, wherein the B has the following formula (III):

(III)

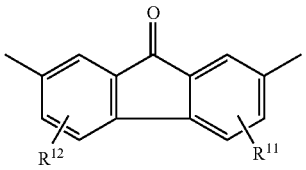

wherein $R_{11}$ and $R_{12}$ independently represent a hydrogen atom, a halogen atom, a substituted or an unsubstituted alkyl group, a substituted or an unsubstituted alkoxy group, and a carboxyl group and its esters.

6. The electrophotographic photoreceptor of claim 3, wherein the B has the following formula (VI):

(VI)

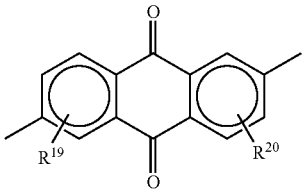

wherein $R_{19}$ and $R_{20}$ independently represent a hydrogen atom, a halogen atom, a substituted or an unsubstituted alkyl group, a substituted or an unsubstituted alkoxy group, and a carboxyl group and its esters.

7. The electrophotographic photoreceptor of claim 3, wherein the B has the following formula (VIII):

(VIII)

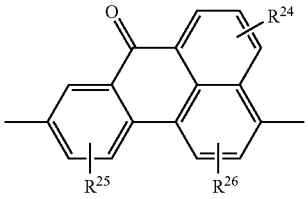

wherein $R_{24}$, $R_{25}$ and $R_{26}$ independently represent a hydrogen atom, a halogen atom, a substituted or an unsubstituted alkyl group, a substituted or an unsubstituted alkoxy group, and a carboxyl group and its esters.

8. The electrophotographic photoreceptor of claim 1, wherein the pigment is a titanylphthalocyanine pigment.

9. The electrophotographic photoreceptor of claim 8, wherein the titanylphthalocyanine pigment comprises titanylphthalocyanine having the following formula (10):

(10)

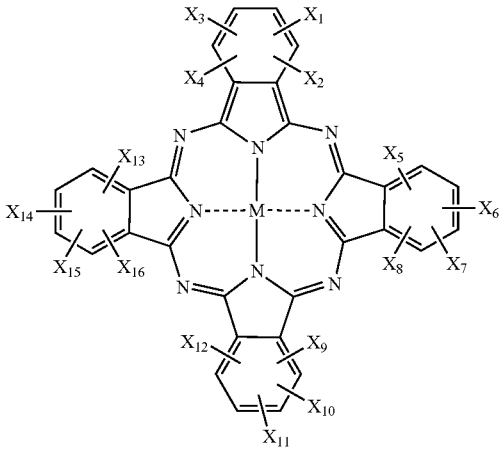

wherein M is TiO; and $X_1$ to $X_{16}$ independently represent a hydrogen atom, a halogen atom, a hydroxyl group, a nitro group, a cyano group, an ester group, an alkyl group, an alkenyl group, an alkoxyl group, an aryl group and an aryloxyl group.

10. An image forming apparatus, comprising:

the electrophotographic photoreceptor according to claim 1 a charger configured to charge the electrophotographic photoreceptor;

an irradiator configured to irradiate the surface of the photoreceptor to form an electrostatic latent image on the photoreceptor;

an image developer configured to develop the electrostatic latent image with toner to form a toner image; and a transferer configured to transfer the toner image onto a receiving material.

11. The image forming apparatus of claim 10, further comprising:

a cartridge detachable therefrom, comprising the electrophotographic photoreceptor; and at least one of the charger, the irradiator, the image developer, the transferer, and a cleaner.

12. A process cartridge, comprising:

the electrophotographic photoreceptor according to claim 1 and at least one of a charger;

an irradiator;

an image developer;

a transferer; and a cleaner.

13. The electrophotographic photoreceptor of claim 1, wherein the complex azo pigment is prepared by dissolving in the organic solvent and de-carbo esterifying the second azo compound having a carbo-ester group and the formula (I) to prepare the first azo compound having formula (a) followed by addition of the pigment selected from the group consisting of quinacridone, titanium oxide, fullerene, titanylphthalocyanine, and the other azo pigments different from the azo compound having the formula (a), to said organic solvent.

* * * * *